US008167223B2

(12) United States Patent
Jensen et al.

(10) Patent No.: US 8,167,223 B2
(45) Date of Patent: May 1, 2012

(54) SHREDDER AND AUTO FEED SYSTEM

(75) Inventors: Michael Dale Jensen, Wood Dale, IL (US); Tai Hoon K. Matlin, Round Lake Beach, IL (US)

(73) Assignee: Fellowes, Inc., Itasca, IL (US)

( * ) Notice: Subject to any disclaimer, the term of this patent is extended or adjusted under 35 U.S.C. 154(b) by 253 days.

(21) Appl. No.: 12/579,887

(22) Filed: Oct. 15, 2009

(65) Prior Publication Data

US 2010/0032505 A1 Feb. 11, 2010

Related U.S. Application Data

(63) Continuation-in-part of application No. 11/777,827, filed on Jul. 13, 2007, now Pat. No. 7,828,235.

(51) Int. Cl.
*B02C 23/00* (2006.01)
*B02C 4/32* (2006.01)

(52) U.S. Cl. ..... 241/34; 241/100; 241/101.3; 241/236

(58) Field of Classification Search ..... 241/34, 241/36, 100, 101.1, 236
See application file for complete search history.

(56) References Cited

U.S. PATENT DOCUMENTS 4,192,467 A 3/1980 Hatanaka
4,231,530 A 11/1980 Hatanaka
4,232,860 A 11/1980 Brown
4,529,134 A * 7/1985 Williams ..... 241/30
4,815,669 A 3/1989 Fujii
4,815,670 A 3/1989 Iwai
4,817,877 A 4/1989 Itoh et al.
4,821,967 A 4/1989 Moriyama
4,878,626 A 11/1989 Leuthold et al.
4,957,243 A 9/1990 Kanagaki et al.
(Continued)

FOREIGN PATENT DOCUMENTS

DE 3215380 A1 10/1983
(Continued)

OTHER PUBLICATIONS

Rexel SHRD UK/EU Rexel Auto+ C/C shredder product description and datasheet from Rexel website, obtained from <url: http://www.rexeleurope.com/rexel/en/gb/p/217/2101998/shrd+uk-eu+rexel+auto%2b+c-c.aspx> (2 pages).

(Continued)

*Primary Examiner* — Bena Miller
(74) *Attorney, Agent, or Firm* — Pillsbury Winthrop Shaw Pittman LLP

(57) ABSTRACT

An auto feed shredding apparatus has cutter elements for destroying articles and a mechanism for advancing articles from a tray and into the cutter elements for shredding. A method for advancing articles to be shredded is also described. A feed mechanism is used to lift articles from atop a stack and feed them into the shredder mechanism. The articles in the tray may be lifted via exhaust of a blower or a fan, and drawn to towards the feed mechanism via a vacuum. The shredder apparatus may also include a stripping device for removing articles that are stapled together. A number of sensors for determining an amount of articles queued in the tray and an accumulation of shredded articles in a container may also be provided. The sensors may be used to perform a predetermined operation of the shredder, such as alerting a user of an overload or shredding articles.

35 Claims, 12 Drawing Sheets

U.S. PATENT DOCUMENTS

| | | | | |
|---|---|---|---|---|
| 4,986,481 | A | 1/1991 | Fujii et al. | |
| 5,009,410 | A | 4/1991 | Fujii et al. | |
| 5,188,301 | A | 2/1993 | Hasegawa | |
| 5,261,614 | A | 11/1993 | Schwelling | |
| 5,362,002 | A | 11/1994 | Tsai | |
| 5,538,193 | A * | 7/1996 | Takahashi et al. | 241/33 |
| 5,662,280 | A | 9/1997 | Nishio et al. | |
| 5,743,473 | A | 4/1998 | Gregg | |
| 5,772,129 | A | 6/1998 | Nishio et al. | |
| 5,871,162 | A | 2/1999 | Rajewski | |
| 5,884,855 | A | 3/1999 | Chang | |
| 5,954,279 | A | 9/1999 | Siegfried et al. | |
| 6,390,397 | B1 | 5/2002 | Ko | |
| 7,040,559 | B2 | 5/2006 | Matlin et al. | |
| 7,500,627 | B2 | 3/2009 | Park et al. | |
| 2001/0011793 | A1 | 8/2001 | Suzuki et al. | |
| 2002/0190146 | A1 | 12/2002 | Irwin | |
| 2005/0023745 | A1 | 2/2005 | Morimoto et al. | |
| 2005/0072870 | A1 | 4/2005 | Dziesinski et al. | |
| 2005/0274836 | A1 | 12/2005 | Chang | |
| 2006/0054727 | A1 | 3/2006 | Ko | |
| 2006/0179987 | A1 | 8/2006 | Park et al. | |
| 2006/0249609 | A1 | 11/2006 | Huang | |
| 2007/0235573 | A1 | 10/2007 | Johnson | |
| 2008/0179436 | A1 | 7/2008 | Kuraoka | |
| 2008/0197220 | A1 | 8/2008 | Tsai | |
| 2009/0008871 | A1 | 1/2009 | Omi | |
| 2011/0056952 | A1 * | 3/2011 | Borowski et al. | 220/495.06 |
| 2011/0165035 | A1 * | 7/2011 | Lewis et al. | 422/291 |

FOREIGN PATENT DOCUMENTS

| | | | |
|---|---|---|---|
| EP | 0281136 | A2 | 9/1988 |
| WO | 2008095693 | A1 | 8/2008 |
| WO | 2009035178 | A1 | 3/2009 |

OTHER PUBLICATIONS

International Search Report and Written Opinion for PCT International Application No. PCT/US2008/066531, mailed Oct. 22, 2008.

International Preliminary Report on Patentability for PCT International Patent Application No. PCT/US2008/0665311, mailed Mar. 31, 2011.

* cited by examiner

SHREDDER AND AUTO FEED SYSTEM

CROSS-REFERENCE TO RELATED APPLICATIONS

This application is continuation-in-part of U.S. patent application Ser. No. 11/777,827, filed Jul. 13, 2007 and currently pending, the entire content of which is incorporated herein by reference.

BACKGROUND OF THE INVENTION

1. Field of Invention

The present invention is generally related to an apparatus having cutter elements for destroying documents such as paper sheets. In particular, the apparatus comprises a mechanism for advancing articles from a stack in a tray into the cutter elements for shredding.

2. Background

A common type of shredder has a shredder mechanism contained within a housing that is mounted atop a container. The shredder mechanism typically includes a series of cutter elements that shred articles such as paper that are fed therein and discharge the shredded articles downwardly into the container. An example of such a shredder may be found, for example, in U.S. Pat. No. 7,040,559.

Prior art shredders have a predetermined amount of capacity or amount of paper that can be shredded in one pass between the cutter elements. Typically, the sheets of paper are fed into the shredder mechanism manually. Thus, when an operator needs to shred, he or she can only shred a number of sheets of paper by manually inserting one or more sheets one pass at a time. Examples of such shredders are shown in U.S. Pat. Nos. 4,192,467, 4,231,530, 4,232,860, 4,821,967, 4,986,481, 5,009,410, 5,188,301, 5,261,614, 5,362,002, 5,662,280, 5,772,129, 5,884,855, and 6,390,397 B1 and U.S. Patent Application Publications 2005/0274836 A1, 2006/0179987 A1, 2006/0179987 A1, 2006/0249609 A1, and 2006/0249609 A1, which are all hereby incorporated by reference in their entirety.

Other shredders are designed for automatic feeding. The shredder will include a bin in which a stack of documents can be placed. A feeding mechanism can then feed the documents from the stack into the shredding mechanism. This type of shredder is desirable in an office setting for productivity reasons, as the user can leave the stack in the bin and leave the shredder to do its work. With manual feed shredders, the user would have to spend time feeding smaller portions of the stack manually, thus taking away from productivity time.

Furthermore, sensing devices alert a user to safety or issues which may affect the performance of the shredder. For example, the bin being full of shredded paper or an amount of paper queued or inserted for shredding may be determined. However, such sensors tend to be mechanically limited, and fail to dynamically determine performance characteristics. Examples of such devices are shown in U.S. Patent Application Publications 2005/0274836 A1 to Chang and 2006/0249609 A1 to Huang. Rexel, an ACCO Brands Company, also has a bulk autofeed shredder (e.g., Product Code 2101998) for auto-shredding documents. Using sensors to cooperatively determine information related to shredding in an auto-feed shredder would further improve shredding performance.

SUMMARY OF THE INVENTION

One aspect of the invention provides a shredder comprising a housing and a shredder mechanism received in the housing and including a motor and cutter elements. The motor rotates the cutter elements in an interleaving relationship for shredding articles fed therein. Also provided in the shredder is a tray for holding a stack of articles to be fed into the cutter elements, a feed mechanism for feeding articles from the tray to the cutter elements of the shredder mechanism, and a feed driver system constructed to drive the feed mechanism to feed articles to the cutter elements. The feed mechanism has an engaging surface for engaging articles. The shredder further has a waste level sensor operable to detect an accumulation of shredded particles discharged by the shredder mechanism and a queue sensor operable to determine an amount of articles provided on the tray. A controller is coupled to the shredder mechanism, feed driver system, waste level sensor, and queue sensor. The controller is configured to compare the accumulation of shredded particles detected by the waste level sensor to the amount of articles provided on the tray detected by the queue sensor, in order to perform a predetermined operation of the shredder.

Another aspect of the invention provides a method for operating a shredder. The method includes: providing a tray for holding a stack of articles; providing a shredder mechanism including a motor and cutter elements; and providing a feed mechanism for feeding articles from the tray to the cutter elements of the shredder mechanism. The feed mechanism has an engaging surface. The method also includes: providing a waste container for receiving shredded particles from the cutter elements; determining an amount of articles provided on the tray using a queue sensor; determining an amount of space available in a container for receiving shredded particles from the cutter elements using a waste level sensor, using a controller to compare the amount of articles provided on the tray to the amount of space available for collecting shredded particles in the waste container, and, based on a comparison of the amount of articles to the amount of space available, performing a predetermined operation of the shredder.

Other aspects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 1:
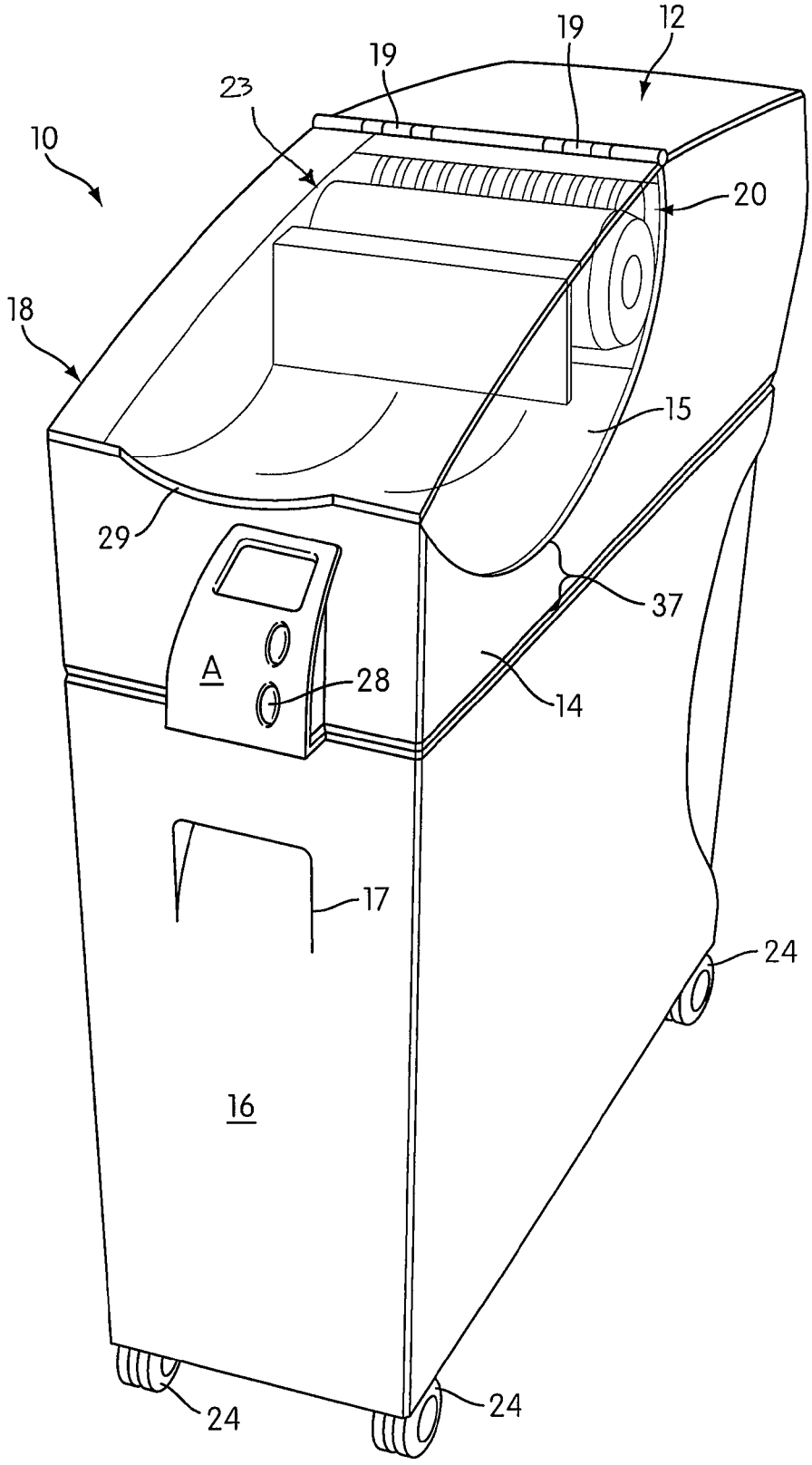
FIG. 1 is a perspective view of a shredder in accordance with an embodiment of the present invention.
Figure 2:
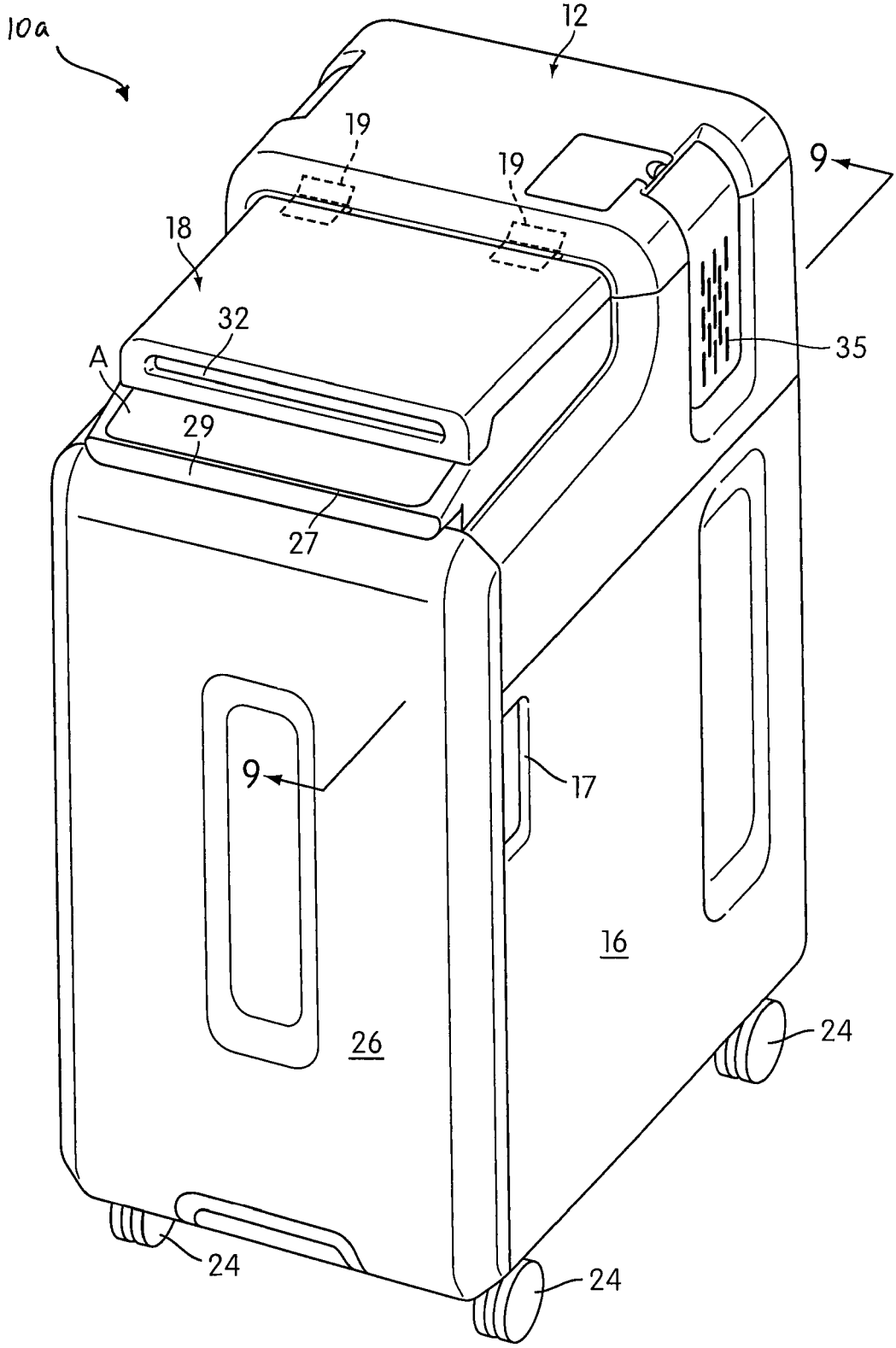
FIG. 2 is a perspective view of a shredder in accordance with another embodiment of the present invention.

FIGS. 1 and 2 are perspective views of shredders 10 and 10*a* in accordance with embodiments of the present invention. The shredders 10 and 10*a* are designed to destroy or shred articles such as paper, envelopes, CDs, DVDs, and the like. For explanatory purposes only, throughout this description, each shredder 10 and 10*a* is described as holding and feeding papers and/or sheets for shredding. However, it is noted that any type of article may be provided in the shredder 10 or 10*a* and thus should not be limited with regard to its description. Furthermore, the shredders 10 and 10*a* are intended to be exemplary embodiments for automatic feeding or "auto feed" shredding devices. For purposes of this disclosure, an "auto feed" shredder is defined as a shredder comprising a device for advancing articles towards a shredder mechanism such that the articles may be shredded or destroyed without manual feeding.

The shredder 10 of FIG. 1 comprises a housing 12 that sits on top of a container 16, for example. The container 16 receives paper that is shredded by the shredder 10. In some cases, the container 16 may be a waste bin, or hold a separate waste bin, for receiving and/or collecting shreds from the shredding mechanism 20. The container 16 may comprise a handle 17, which may be in the form of a hole, opening, or section for a user to grasp. For example, the user may grab handle 17 to open or access the inside of the container 16. The container 16 may be a waste bin, or may also be used to house a separate and removable waste bin, for example. To access the contents (e.g., shreds) within the container, the housing 12 is removed upwardly (i.e., detached) from a top portion of the container 16.

Alternatively, the shredder 10*a* of FIG. 2 comprises a housing 12 that sits on top of container 16 which has a handle 17 for grasping and a front pull out portion 26. The front pull out portion 26 may be moved with respect to the container 16 to access contents (e.g., shreds) in the container 16. For example, as noted above, the container 16 or a waste bin may be provided therein. Front pull out portion 26 may provide access to the container.

Figure 7A:
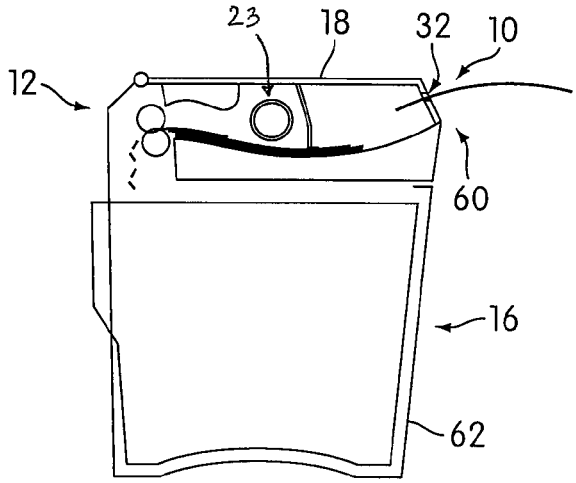
FIG. 7*a* shows a side view of a shredder of alternate configuration comprising a detachable paper shredder mechanism in accordance with an embodiment.
Figure 7B:
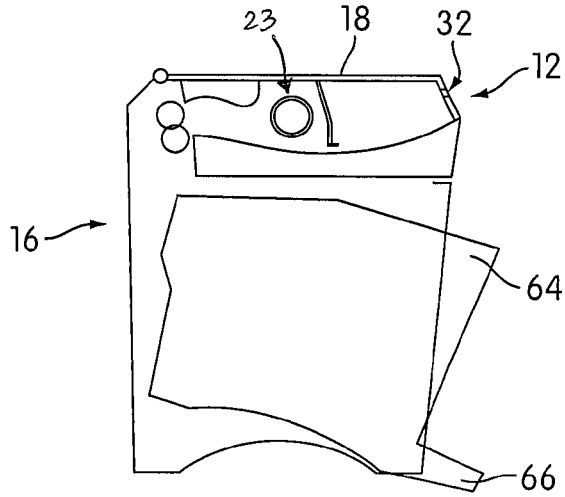
FIG. 7*b* shows a side view of a shredder of alternate configuration comprising a removable waste bin in accordance with an embodiment.
Figure 7C:
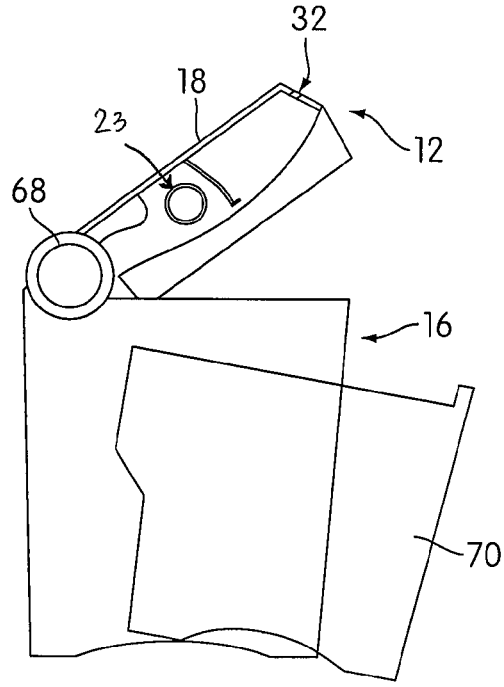
FIG. 7*c* shows a side view of a shredder of alternate configuration comprising a hinged shredder mechanism and a removable waste bin in accordance with an embodiment.

Some example alternate embodiments of containers 16 which may be used with the shredder 10 or shredder 10*a* are further shown in FIGS. 7*a*-7*c*. FIG. 7*a* shows a side view of a shredder device of alternate configuration comprising a detachable paper shredder mechanism 60. The housing 12 may be a detachable shredder mechanism 60 that may be removed from the container 16, for example, for emptying the container 16 (or a waste bin 62) of shredded paper chips or strips, such as shown in FIG. 1.

FIG. 7*b* shows a side view of a shredder device of alternate configuration comprising a removable waste bin 64. In some embodiments, the waste bin 64 may comprise a step or pedal device 66 that allows a user to access the bin and discard waste into the bin 64 without being passed through the shredder mechanism 20. The step or pedal device 66 may also be provided to allow a user to easily access the bin 64 for emptying shredded paper, for example.

FIG. 7*c* shows a side view of a shredder device of alternate configuration comprising a housing 12 with a hinge 68 and a removable waste bin 70. The shredder device may comprise the ability for a user to access the container 16 or waste bin 70 by pivoting and lifting the housing 12 on hinge 68. The waste bin 70 may also be removed by a user when shredded paper needs to be removed, for example.

Alternatively, such as shown in FIG. 2, the container 16 may comprise a front pull out portion 26 that is designed to be pulled or moved with respect to the container housing such that the inside of the container 16 or a waste bin being held therein may be accessed.

Although a waste bin is described as being provided in the container 16 in the above embodiments, it is optional and may omitted entirely. Generally, container 16 may have any suitable construction or configuration. As such, the design and configuration of the shredder and its elements should not be limiting.

The shredders 10 or 10*a* may or may not be portable or movable. For example, in some embodiments, the shredders 10 and 10*a* may include rotatable rollers 24 or wheels. Generally speaking, the shredder 10 or 10*a* may have any suitable construction or configuration and the illustrated embodiments are not intended to be limiting in any way.

Figure 4:
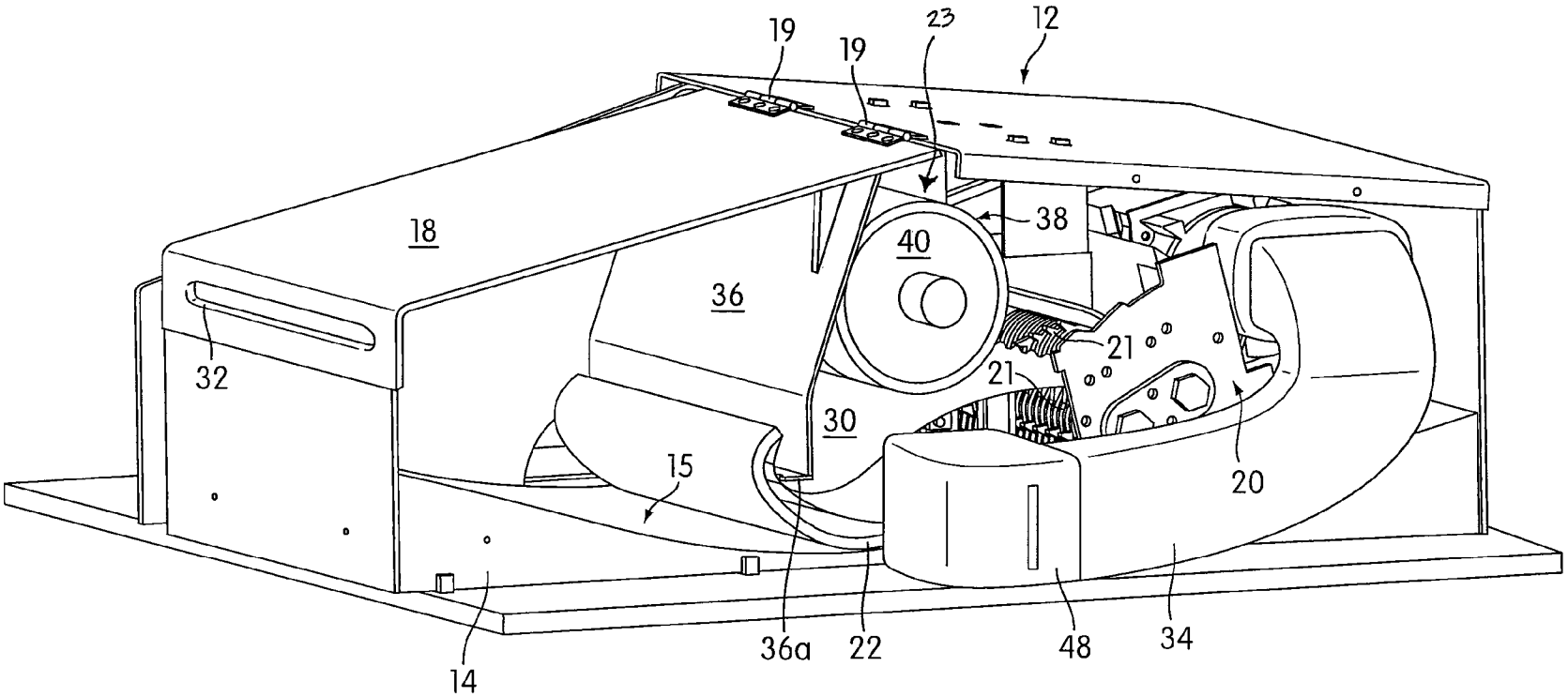
FIG. 4 is a detailed side view of a rotatable drum, stripping device, and tray of the shredder of FIG. 2 in accordance with an embodiment of the present invention.

Shredder 10, 10*a* comprises a paper shredder mechanism 20 in the housing 12, and includes a drive system with at least one motor 45, such as an electrically powered motor, and a plurality of cutter elements 21 (e.g., see FIG. 4). The cutter elements are mounted on a pair of parallel mounting shafts (not shown). The motor 45 operates using electrical power to rotatably drive first and second rotatable shafts of the shredder mechanism 20 and their corresponding cutter elements 21 through a conventional transmission so that the cutter elements 21 shred or destroy articles fed therein. The shredder mechanism may also include a sub-frame for mounting the shafts, motor, and transmission. The drive system may have any number of motors and may include one or more transmissions. Also, the plurality of cutter elements 21 are mounted on the first and second rotatable shafts in any suitable manner and are rotated in an interleaving relationship for shredding paper sheets fed therein. The operation and construction of such a shredder mechanism 20 is well known and need not be discussed herein in detail.

The housing 12 of shredder 10 is designed to sit atop a container 16, as noted above. The housing 12 works in cooperation with a cartridge or tray 14, shown as an exploded detail of shredder 10*a* in FIG. 3. Tray 14 comprises a feed bed 15 and is designed to hold a plurality or stack of paper sheets 22 that are to be shredded. The tray 14 is mounted such that the paper may be fed from bed 15 of the tray 14 and into the cutter elements 21 of the shredder mechanism 20. For example, the tray 14 and shredder mechanism 20 may be mounted horizontally such that the paper is fed into the shredder mechanism 20 and destroyed.

In an embodiment, the tray 14 comprises a curved or sloped feed bed 15 (see, e.g., FIGS. 6*a*-6*e*). The curved or sloped geometry of the feed bed 15 assists in feeding sheet(s) atop a stack 22 in a forward and upward direction into the shredder mechanism 20, for example. A curved or sloped feed bed 15 also assists in preventing jamming of the paper in the shredder mechanism 20. Additionally, the curved surface of the bed 15 may create drag on the articles or paper, which assists in breaking down a stack into smaller allowable overlapped stacks to be processed by the mechanism 20 when the articles are being auto-fed. Thus, multiple sheets may be feed continuously into the cutter elements 21. In some embodiments, the bed 15 may be parabolic.

In another embodiment, it is envisioned that the tray 14 may comprise a sectioned or partitioned bin, providing limited access to an upper bin, for example, while documents in lower bin are fed to the shredder mechanism 20.

In an embodiment, the tray 14 is provided with a lid 18. The lid 18 is provided with hinges 19 such that the lid 18 may be pivoted between an open and closed position. The lid 18 may assist in reducing the amount of noise transmitted into the air during operation of the shredder, for example. It may also provide safety features, which are noted below. Pivoting the lid 18 allows a user access to the inside of tray 14, such as for filling the tray 14 with paper to be shredded. The hinges 19 may be provided on an outside (see FIG. 1) or an inside (see FIG. 2) of the housing 12. In an embodiment, the tray 14 comprises a handle or grasp element 29 to assist in lifting the lid 18. For example, FIGS. 1 and 2 illustrate possible embodiments of the handle or grasp element 29. FIGS. 1 and 2 illustrate handles 29 in alternate forms of a lip provided near or on an edge of the lid 18, near control panel A. In an embodiment, a handle or grasp element may extend from the side of the lid 18 on top of tray 14. However, any type or form of grasp element 29 for assisting in lifting or opening the lid 18 so that the tray or feed bed may be accessed may be used and should not be limiting.

In an embodiment, the lid 18 may comprise a safety switch. The safety switch may be used to detect if the lid is pivoted to an open position. The safety switch may be coupled to the shredder mechanism 20 to prevent operation of the cutter elements 21 when the lid 18 is in the open position. Similarly, when the lid 18 is in a closed position, the shredder mechanism 20 may be activated to begin operation of the cutter elements 21 and an advancement (or feed) mechanism, as will be described.

The tray 14 or lid 18 may also comprise a locking mechanism that prevents a user from opening the lid or accessing the tray, which may not be desirable while the shredder is in use. For example, the lid 18 may include a magnetic latch. Alternatively, the tray or lid may include a code lock that prevents a user from opening the lid or having access to the tray. For example, a user may need to input a code into a control panel, such as a control panel A, for access to the documents to be shredded in the tray 14. Further description for an example control panel A is provided with respect to FIG. 8 below.

In an embodiment, lid 18 may comprise an opening or slot 32 for allowing insertion of paper sheets into the tray 14. Thus, the tray 14 may also be filled by inserting paper sheets (e.g., a single sheet or a small stack) through the slot 32 and into the feed bed without having to lift the lid 18. This feature may be advantageous, for example, when the shredder mechanism (including cutter elements 21 and its advancement mechanism) is running and feeding from a large stack and the user simply wants to add a small number of documents to the tray 14 or bed 15. Rather than opening the lid 18 and stopping the shredding process with the safety switch, the user can just slip the small number of documents into the stack 22 on the bed 15 via the slot 32. In another embodiment, an opening may be provided below the lid 18. For example, when the lid 18 is in the closed position, an opening or gap may be formed between the lid and a portion of the tray 14 or feed bed. However, the use of a lid in general is optional and may be omitted entirely. A user may add paper to the tray 14 through an open top, for example.

The tray 14 is designed to hold a stack 22 of paper sheets therein that are to be shredded. The paper sheets may be of any type, size, or construction (e.g., white paper, letter size, legal size, A4, envelopes, etc.).

Figure 8:
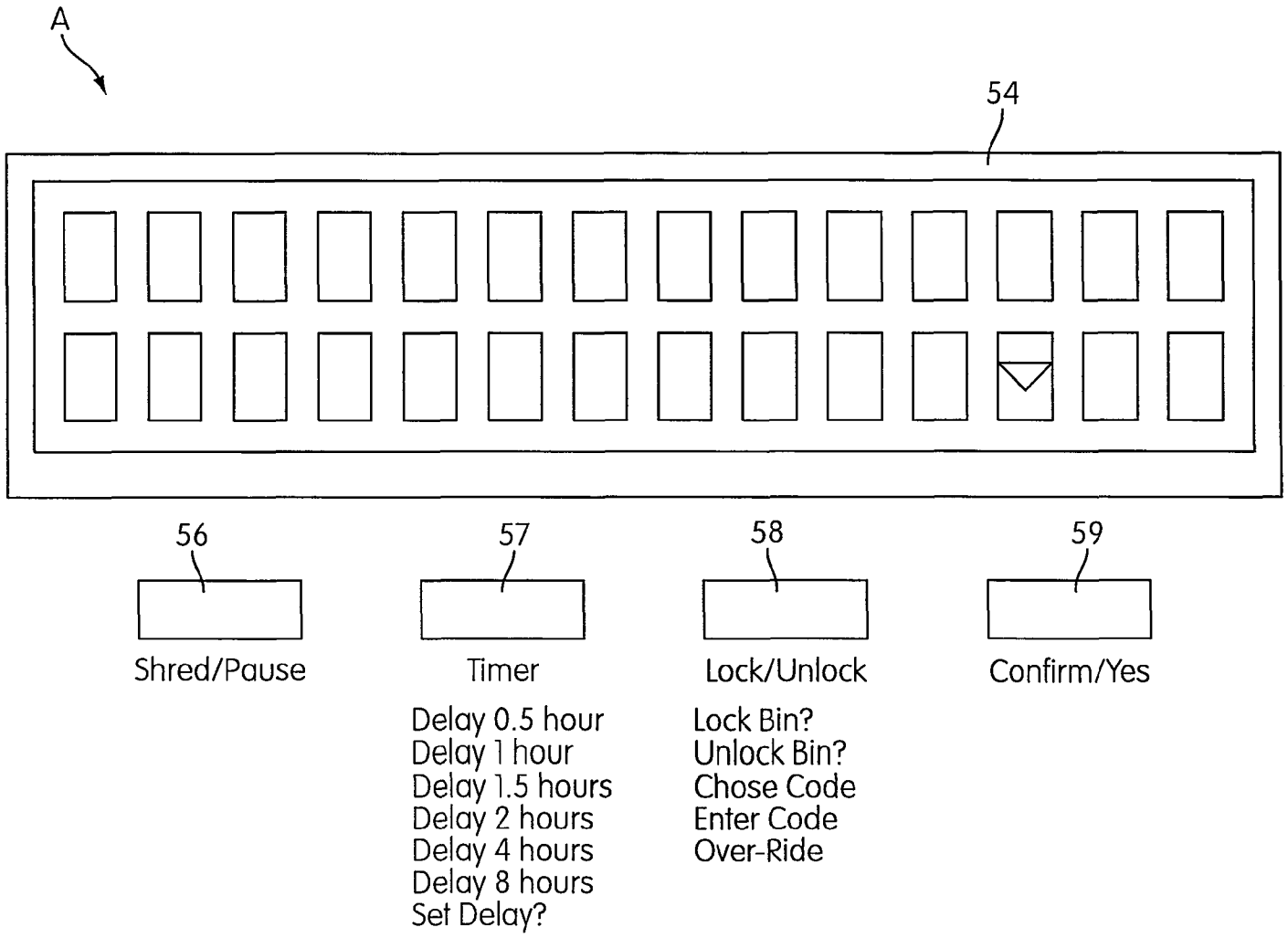
FIG. 8 is a detailed view of a control panel for use with the shredder of FIG. 2 in accordance with an embodiment of the present invention.

As previously noted, a control panel A may be provided for use with the shredder 10. FIG. 8 illustrates a detailed view of a control panel A in accordance with an embodiment of the present invention. As shown, the control panel A comprises at least a screen 54 and may comprise a plurality of buttons 56, 57, 58, and 59. Any number of buttons may be provided. The screen 54 may be an LCD screen, for example, to show available menus or options to a user. In some instances, the screen 54 may be a touch screen which provides the buttons 56-59. Lights, LEDs, or other known devices (not shown) may also be provided on control panel A. Generally, the use of a control panel is known in the art.

The buttons 56-59 on control panel A are provided to assist the user with the shredder 10 and communicate actions to the controller 47, e.g., to turn on the shredder mechanism or provide power, start the timing mechanism, etc. For example, button 56 may be used to communicate the state of the shredder's particular condition (e.g., ON, OFF). Button 56 may be used to activate or pause the activation or movement of shredder mechanism 20 in the shredder 10. The status of the shredder, e.g., "Shredding" or "Pause" may also appear on the screen 54, for example.

Button 57 may be a timer button, for example. In an embodiment, the timer button 57 is used to set a time delay. The button 57 may be pressed by a user to display or scroll through available delay times for setting the shredder mechanism 20 on a delayed start, for example, such as 30 minutes or 1 hour. Once a user chooses a time delay, the user then confirms the selection by pressing the confirmation button 59, for example. Thus, the timer button 57 used to set a timer (not shown) for controlling at least a time to start movement of an advancement or feed mechanism 23 to advance paper sheets into the shredder mechanism 20, as will be described in the embodiments below.

Button 58 may be a lock/unlock button, for example, that allows a user to lock access to the bin. For example, as noted above, lid 18 may include a magnetic latch for prohibiting access to the tray 14. Thus, lock button 58 may be used to lock the magnetic latch and therefore prevent a user from opening the lid or having access to the tray. To unlock the lid 18 and provide the user access to the tray 14, a user presses lock button 58 and inputs a code into the control panel A (e.g., the screen may prompt a user for an unlock code). Similarly, the lock button 58 may be used to lock the lid 18 with respect to the tray 14, such that when the lid 18 is closed, the user presses button 58 and is prompted to enter a code for activating the lock mechanism (e.g., magnetic latch).

As previously noted, button 59 may be provided as a confirmation button, allowing a user to confirm a selection or entry when completed or when prompted. Thus, when a user wants to complete entry of a code, either for unlocking or locking, the confirmation button 59 may be pressed. Of course, the associated duties of the above buttons should not be limiting. Furthermore, it should be understood that the noted duties may change (i.e., each button may be re-assigned one or more tasks or duties) depending upon the elements on the screen 54 and/or status of shredding, for example.

A separate power switch 28 may also be provided on the shredder 10. The power switch 28 may be provided on tray 14, for example, on the control panel A, or anywhere else on the shredder 10. The power switch 28 may include a manually engageable portion connected to a switch module (not shown). Movement of the manually engageable portion of switch 28 moves the switch module between states. The switch module is communicated to a controller 47 which may include a circuit board. Typically, a power supply (not shown) is connected to the controller by a standard power cord with a plug on its end that plugs into a standard AC outlet. The controller 47 is likewise communicated to the motor 45 of the shredder mechanism 20 (e.g., see FIG. 12). When the switch 28 is moved to an on position, the controller can send an electrical signal to the drive of the motor 45 so that it rotates the cutting elements 21 of the shredder mechanism 20 in a shredding direction, thus enabling paper sheets to be fed therein. The switch 28 may also be moved to an off position, which causes the controller 47 to stop operation of the motor. Further, the switch 28 may also have an idle or ready position, which communicates with the control panel A. The switch module contains appropriate contacts for signaling the position of the switch's manually engageable portion. Generally, the construction and operation of the switch 28 and controller 47 for controlling the motor 45 are well known and any construction for these may be used. Also, the switch need not have distinct positions corresponding to on/off/idle, and these conditions may be states selected in the controller by the operation of the switch.

The shredders 10, 10*a* also comprise a feed mechanism 23 opposed to or adjacent the tray surface for advancing at least a top sheet from a stack of paper in a tray into the cutter elements for shredding. That is, shredder 10 is designed with an advancement mechanism for automatically feeding articles from the tray 14 to a shredder mechanism 20 without requiring a user to manually feed individual or a preset quantity of sheets into the cutting elements 21. As shown, feed mechanism 23 is generally disposed above the tray 14. The feed mechanism may comprise an engaging surface for engaging articles (e.g., temporarily) to feed them into the shredder mechanism 20. Also included in the shredders is a feed driver system 67 (e.g., see FIG. 12) constructed to drive the feed mechanism 23 to feed articles to the cutter elements 21 of the shredder mechanism 20. Generally, the feed mechanism 23 may comprise several designs and should not be limiting.

FIG. 4 illustrates a side view of an exemplary embodiment of an advancement mechanism for shredder 10 or 10*a* in accordance with the present invention, comprising a rotatable drum mechanism 38. Although the rotatable drum mechanism 38 is further described below, it is noted that any number of alternate feed mechanisms 23 may be used and are within the scope of this disclosure. For example, it is envisioned that moveable roller or rotating feed mechanisms, such as those that are disclosed in U.S. application Ser. No. 11/777,827, filed Jul. 13, 2007, which is incorporated herein in its entirety, may be used in accordance with some embodiments of the present disclosure. As such, it is to be understood that the rotatable drum mechanism 38 as described herein should not be limiting.

Referring back to the exemplary embodiment, the rotatable drum mechanism 38 comprises a rotatable drum 40, vacuum generator 46 (e.g., see FIGS. 6*a*-6*e*), vacuum vent 44, exhaust 48, and a feed driver system 79 (e.g., see FIG. 12) designed to work in cooperation with the stack 22 in the tray 14. As shown, the rotatable drum 40 is positioned above or adjacent the bed 15 of the tray 14 and along a horizontal axis.

The rotatable drum 40 comprises a generally round configuration. The drum 40 may be of a circular or oval shape, for example. In an embodiment, the rotation of drum mechanism 38 or drum 40 is activated when the shredder mechanism 20 is activated. In an embodiment, for example, the rotation of drum 40 is activated when the lid 18 of tray 14 is moved to a closed position (i.e., inhibiting access to the bed 15 of the tray 14). In an embodiment, the drum 40 is rotated using a motor (s) and/or drive wheel mechanism(s). In an embodiment, the drum 40 is rotated and activated for rotation using the same motor used to drive the shredder mechanism 20. For example, the rotation of the drum 40 may be linked by belts, axles, or gears, as known in the art, to rotate upon activation of the cutter elements 21 in the shredder mechanism 20. In an embodiment, the drum 40 uses a separate motor for rotation.

In an embodiment, the vacuum generator 46 and/or rotation of drum 40 is activated when the shredder mechanism 20 is activated. In an embodiment, the vacuum generator 46 and/or rotation of drum 40 is activated when the lid 18 of the tray 14 is moved to a closed position.

Figure 5:
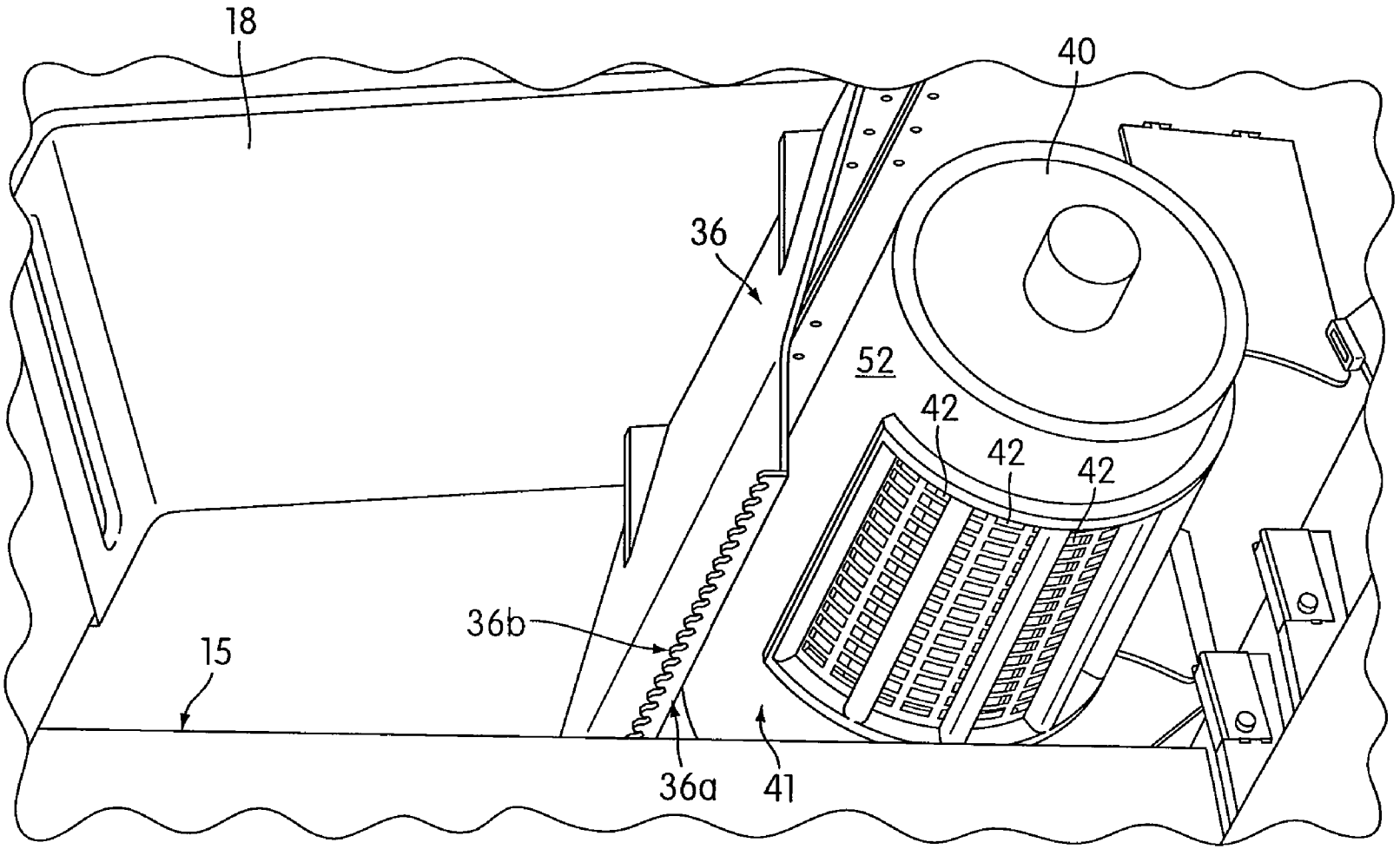
FIG. 5 is a detailed underside view of the rotatable drum and stripping device of FIG. 4.

As shown in detail in FIG. 5, the rotating drum 40 has an exterior paper engaging surface 52 that is at least in part air permeable. In some embodiments, the paper engaging surface 52 has one or more openings 42. The one or more openings 42 form at least part of the paper engaging surface 52. In an embodiment, the opening(s) 42 are provided at least partially around the drum circumference. For example, the opening(s) 42 may be provided in succession along 90 degrees (i.e., one-quarter of the way around) or along 180 degrees (i.e., halfway around) of the entire 360 degree circumference of the drum. In some cases, the openings 42 may include a mesh or hatched interface, so as to prevent part of the at least top sheet 30 from being withdrawn into the drum 40 via the openings 42, for example. Alternatively, in other embodiments, the entire surface 52 of the drum 40 may be formed of a mesh or hatched material that includes any number or size of openings.

As the drum 40 rotates, a concentrated vacuum (e.g., from fan 46 applied to the interior of inner cylinder) is applied through the openings 42 toward stack 22, so as to lift at least one sheet atop the stack 22 towards the adjacent paper engaging surface 52 of the drum 40. Thus, the top sheet(s) 30 is lifted from the stack 22 using a maximum vacuum force along the paper engaging surface 52. As the openings 42 of the drum 40 rotate around and away, the sheet(s) of paper may be released and pulled into the shredder mechanism 20 by the cutter elements 21 for shredding of the sheet(s), for example.

In one embodiment, the rotating drum 40 comprises an inner cylinder 43 and an outer cylinder 41. For example, with reference to FIG. 5, the outer cylinder 41 of the drum 40 has a plurality of openings 42 at least partially around its circumference, such as those noted above (e.g., with mesh) and the inner cylinder 43 is provided within the outer cylinder 41. The inner cylinder may comprise at least one opening (not shown) focused toward the stack 22 in the tray 14. During operation, the outer cylinder 41 may rotate with respect to the inner cylinder 43 (and stack 22). As the outer cylinder 41 rotates, the opening(s) 42 align with the opening(s) of the inner cylinder 43 such that a concentrated vacuum (e.g., from fan 46 applied to the interior of inner cylinder) is applied through the openings 42 toward stack 22, so as to lift at least one sheet atop the stack 22 towards the adjacent paper engaging surface 52 of the outer cylinder 41. Thus, the top sheet(s) is lifted from the stack 22 using a maximum vacuum force along the paper engaging surface 52 of the cylinder 41. The sheet(s) of paper may be released as noted above.

In an embodiment, both the outer cylinder 41 and the inner cylinder 43 rotate. The opening(s) 42 of the outer cylinder 41 rotate with respect to the inner cylinder 43 (as the inner cylinder 43 also rotates), and with respect to the stack 22 in tray 14. For example, the outer cylinder 41 may rotate in a clockwise direction, while the inner cylinder rotates in a counter-clockwise direction. Alternatively, in another embodiment, the outer cylinder 41 and inner cylinder 43 may be rotated about a horizontal axis at different speeds.

In any case, as the cylinders in such embodiments rotate, the opening(s) 42 in the paper engaging surface 52 of the outer cylinder 41 align at some point during rotation with the at least one opening (not shown) of the inner cylinder 43. In an embodiment, the openings of the cylinders are designed such that during rotation a concentrated vacuum (e.g., from fan 46 applied to the interior of the drum 40/inner cylinder 43) is applied through openings 42 toward or adjacent the stack 22, thus providing a maximum vacuum force along the paper engaging surface 52. Again, the top sheet(s) of paper from the stack 22 may then be lifted and rotated toward the shredder mechanism 20 as previously described.

The rotatable drum 40 works in cooperation with the vacuum generator 46 to advance paper through the cutter elements 21 of the shredder mechanism 20. In one embodiment, the vacuum generator 46 comprises a fan mechanism and a fan exhaust or blower nozzle 48 (see, e.g., FIG. 6*a*) that are used to feed one or more top sheets from the stack 22 in the tray 14. The vacuum generator or fan 46 is used to apply a vacuum to the interior of the rotatable drum 40, to draw air through the exterior paper engaging surface 52, thereby lifting one or more sheet(s) 30 from atop the stack 22 in the tray 14.

In an embodiment, the exhaust 48 from the fan 46 is blown into the feed bed 15 to raise at least the top sheet(s) of the paper and separate at least the top sheet(s) from the stack of paper sheets 22. That is, the same fan may be used as the vacuum generator and as the blower or exhaust. In another embodiment, two separate fans or mechanisms may be used as the vacuum and blower/exhaust. An exhaust tube extension 34 may also be provided on the shredder or within the tray 14 so as to direct the exhaust air toward the fan exhaust nozzle 48. For example, as shown in FIG. 4, the exhaust tube extension 34 may extend from behind the shredder mechanism 20 and curve adjacently and forwardly toward the feed bed 15 of the tray 14. As shown, the nozzle 48 may direct air or exhaust into and/or towards the stack 22 on the bed 15. The design and location of extension 34 and nozzle 48 in FIG. 4 is one exemplary embodiment, and, therefore, should not be limiting.

An exhaust port (not shown) may also be provided on the outside of the shredder or within the tray 14 so as to lift one or more sheets from the top of the stack 22, as described with respect to FIGS. 6*a*-6*e*.

Referring back to FIG. 3, a vacuum vent 44 may also be provided in shredder 10 or 10*a*. The vacuum vent 44 acts as an inlet for the fan 46. As the fan 46 rotates, it creates a suction force which draws air through the vacuum vent 44. The vacuum vent 44 is shown on a side of the shredder 10; however, the vent 44 may be located at any number of locations in relation to the vacuum generator 46, and should not be limited to the depiction in the illustrated embodiment. Also, vents such as vent 35 may be provided on the housing 12 or lid 18 or container 16 to assist in heat dissipation, for example.

Figure 3:
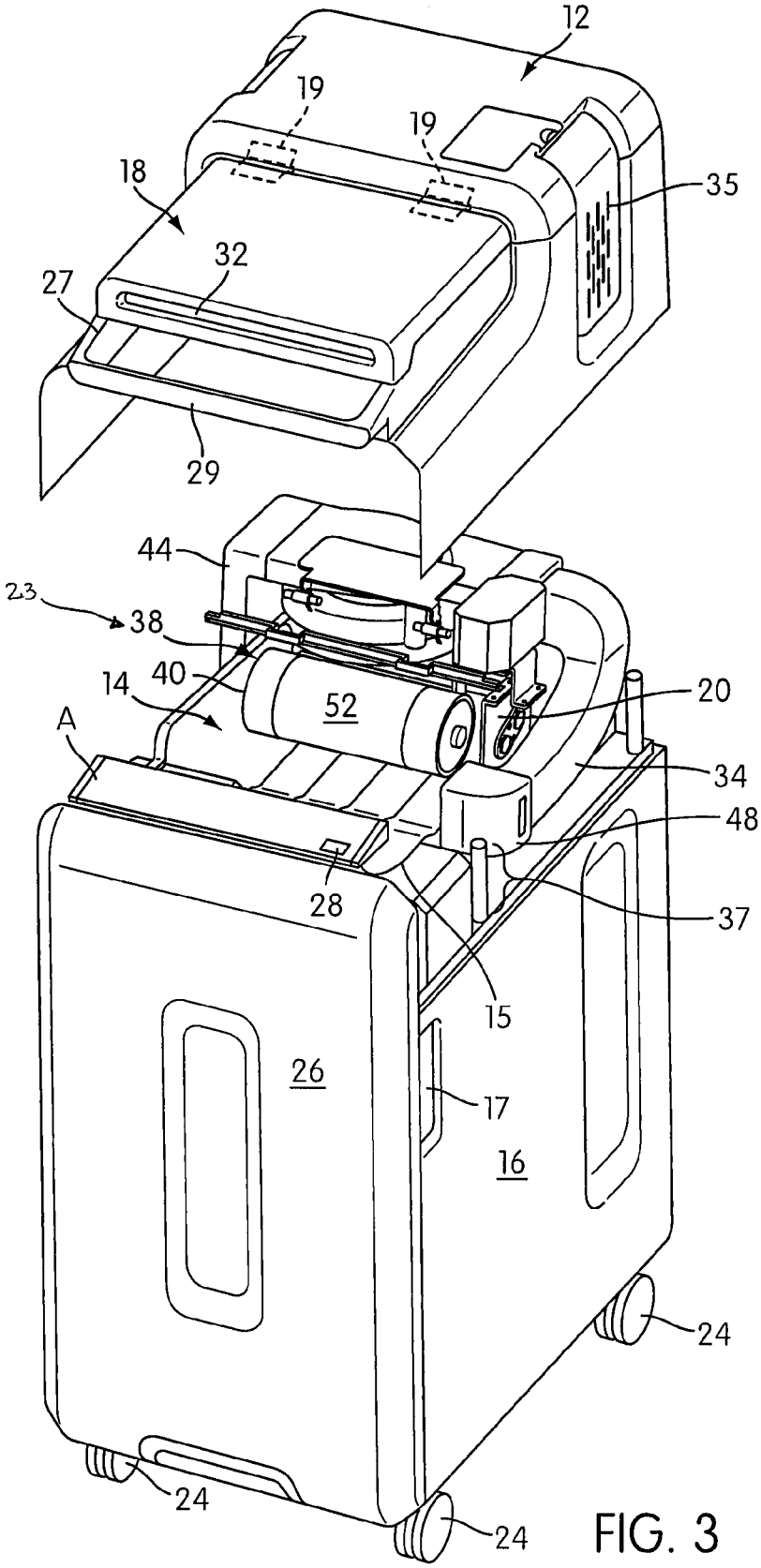
FIG. 3 is an exploded view of the shredder of FIG. 2 in accordance with an embodiment of the present invention.

FIGS. 6*a*-6*e* show side views of the rotatable drum mechanism 38 of FIGS. 1, 3, and 4 for advancing paper in accordance with an embodiment of the present invention. As previously noted, the feed driver system of shredder 10 is constructed to rotate and move the rotatable drum 40. The feed driver system is constructed to move and rotate the rotatable drum 40 such that when at least a top sheet is engaged to its exterior surface 52 it feeds paper atop the stack 22 in the bed 15 of the tray 14 to the cutter elements 21 of the shredder mechanism 20.

Figure 6A:
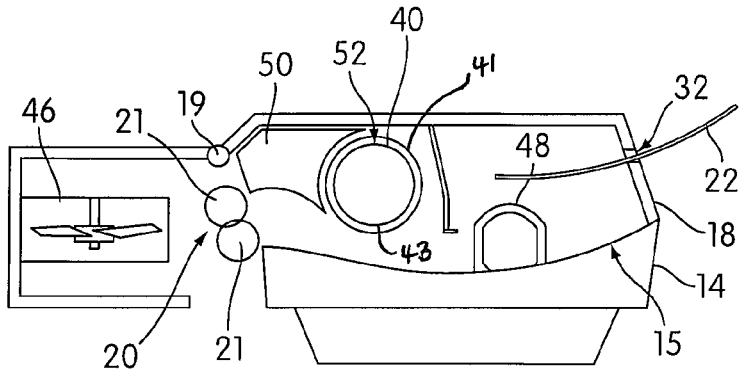
FIGS. 6*a*-6*e* show side views of the rotatable drum and tray of FIG. 4 for advancing paper in accordance with an embodiment of the present invention.
Figure 6B:
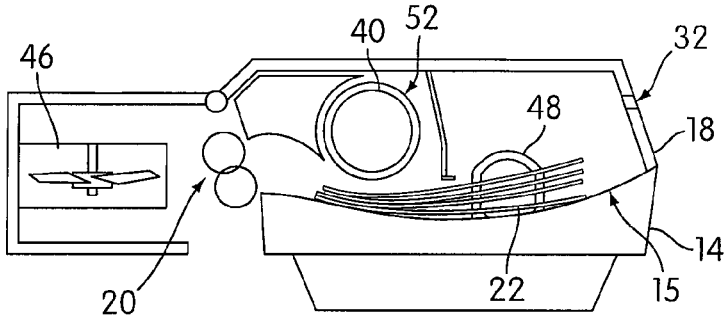

The embodiment of FIGS. 6*a*-6*e* uses a fan 46 to generate both a vacuum and exhaust 48 in the shredder 10. As shown in FIG. 6*a*, the lid 18 may be pivoted upon hinges 19 to allow access to the inside of the tray 14 or feed bed 15. In an embodiment, when the lid 18 is lifted, the rotatable drum 40 (e.g., its vacuum and/or rotation) and feed driver system are deactivated such that paper may be inserted into the feed bed 15 of the tray 14. After insertion of the paper sheets or stack 22, the lid 18 is pivoted closed as seen in FIG. 6*b*, and the shredder mechanism 20, rotatable drum mechanism 38, and feed driver system of the shredder 10 are activated (e.g., upon closure of the lid 18, via a sensor, or manually). For example, as further described below with reference to FIGS. 9-11, one or more sensors may be provided in the shredder, and one or more of such sensors may be used to communicate and/or activate the feed driver system, i.e., the rotatable drum 40. As will be described, the shredder may use optical sensor(s), electromechanical sensor(s), or switch(es), for example.

Figure 6C:
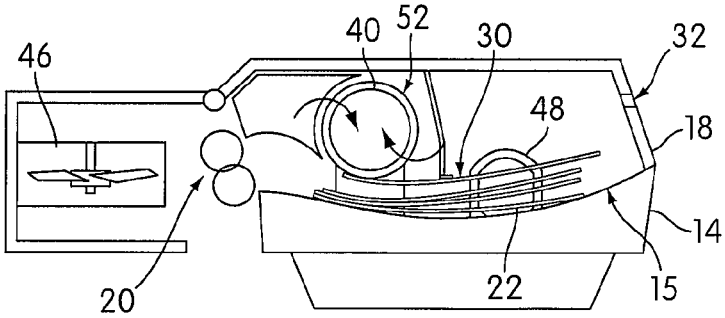
Figure 6D:
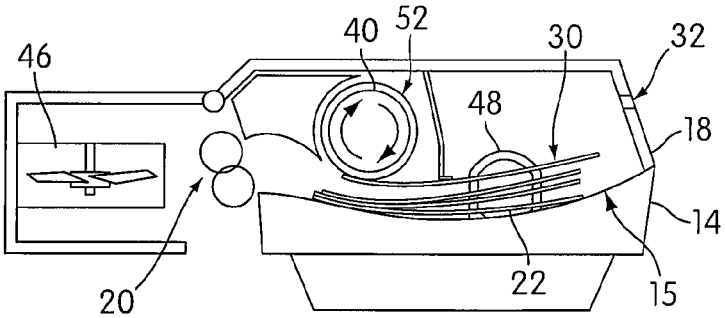
Figure 6E:
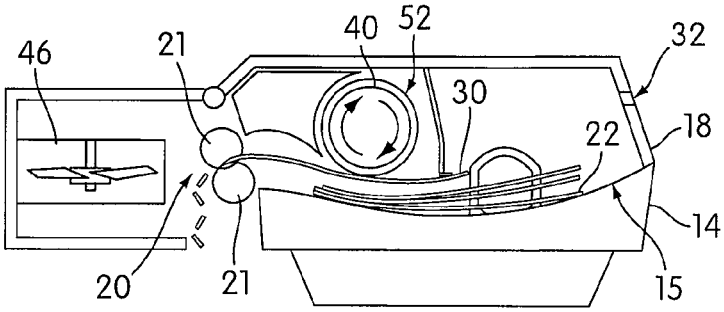

Also, as shown in FIG. 6*e*, when the lid 18 is in the closed position, the opening or slot 32 may also allow for insertion of one or more sheets through the lid 18 and into the feed bed 15 of the tray. Thus, the tray 14 may also be filled by inserting paper sheets (e.g., a single sheet or a small stack) through the slot 32 and into the feed bed 15 without having to lift the lid 18. Again, such sensing devices, such as a queue sensor which may sense the presence or addition of articles into the tray 14 (described in FIG. 9), may be used in the shredder 10 or 10*a*.

In an embodiment, the driver system comprises a timer for controlling at least the start time or activation of vacuum generator or fan mechanism 46. The vacuum or fan 46 is activated to produce a vacuum within the interior of the rotatable drum 40. The vacuum or fan 46 draws air through the exterior paper engaging surface 52 (e.g., through openings 42). As noted above, the fan 46 is used to provide both the vacuum and blower/exhaust 48. Thus, when activated, the blower/exhaust 48 is also activated, blowing air into the tray 14 and bed 15.

As shown in FIG. 6*b*, when the fan 46 is activated and exhaust is directed, for example, through the exhaust tube extension 34 and nozzle 48, the exhaust air directed toward the bed 15 causes at least the top sheet(s) 30 of paper to lift and separate from part of the other sheets of paper in the stack 22. The separation of at least the top sheet 30 of paper from atop the stack 22 allows for the vacuum applied to the center of rotating drum 40 to more easily draw the sheet of paper to the exterior paper engaging surface 52.

As shown in FIG. 6*c*, after initiation of the vacuum 46, one or more top sheets 30 of paper lifts from the stack 22 and onto the exterior paper engaging surface 52. The feed drive system is constructed to rotate the drum 40 to feed at least the top sheet 30 of the stack into the shredder mechanism 20. Specifically, as the rotatable drum 40 rotates, as shown in FIGS. 6*d* and 6*e*, the paper is advanced and fed forward into the shredder mechanism 20 and between cutter elements 21 for shredding. The sheet(s) 30 are grasped and pulled into the shredder mechanism 20 by the cutter elements 21. The exhaust may continue to blow via exhaust nozzle 48 into the bed 15 and keep at least one top sheet of paper slightly lifted and separated from the stack. The rotatable drum 40 continues to grab and advance one or more top sheets into the shredder mechanism 20 until all of the paper sheets in stack 22 have been shredded.

In an embodiment, a filter may be provided in rotatable drum 40 to filter particles that may be drawn in by the vacuum applied to its interior (e.g., paper pieces, dust, etc.).

Also, in an embodiment, the rotation of rotatable drum 40 may be used to advance sheet(s) only partially. Thus, sheets which are torn, folded, of different size (e.g., letter size, legal size, etc.), type (e.g., white paper, envelopes, etc.), or construction are advanced into the shredder mechanism 20. In some cases, the curved or sloped feed 15 may assist in at least partially advancing the sheets therein.

In one embodiment in accordance with the invention, a paper removal device 50 is provided with the shredder 10, 10*a*. FIGS. 6*a*-6*e* show a positioning and use of a paper removal device 50, for example. The paper removal device 50 may be designed such that it at least partially surrounds or at least is positioned adjacent a surface of the rotating drum 40 in the shredder 10. The paper removal device 50 may be provided between the feed driver system and the shredder mechanism. The paper removal device 50 is used to ensure removal of the paper sheet(s) from the rotating drum 40, should the vacuum that is applied to the interior of the drum 40 continue hold the sheet(s) to the exterior paper engaging surface 52. That is, when paper from the stack 22 is lifted to the exterior paper engaging surface 52 via vacuum from fan 46, the paper removal device 50 may provide assistance for removing the paper sheet(s) from the surface 52 as the drum 40 rotates and feeds the paper into the cutter elements 21 of the shredder mechanism 20.

Further, the shredder 10 may also comprise a stripper device 36 for stripping paper sheets from staples, shown in FIGS. 4, 5, and 6, for example (the device 36 is removed from other Figures for simplicity purposes). The stripper device 36 may be provided to extend in or adjacent the tray 14, for example. In one embodiment, as shown in FIGS. 4 and 5, the stripper device 36 is attached to the lid 18. The stripper device 36 may be designed such that it is adjacent to the stack 22 and in front of the feed mechanism 23 or rotatable drum mechanism 38 (or any other advancement mechanism). In an embodiment, the stripper devices 36 is provided in front of a rotating shredder auto-feed mechanism. In an embodiment, the stripper device 36 is provided behind the rotating shredder auto-feed mechanism (e.g., behind rotatable drum 40).

The device 36 is used to strip paper sheets that are stapled or bound together in the stack 22 from a staple (or other binding element) as the paper sheets are fed to the cutter elements of the shredder mechanism 20. In an embodiment, the device 36 has an extended surface or lip 36*a* that extends into the path of which stapled sheets or documents are drawn. The lip 36*a* may include a plurality of teeth 36*b*, for example, which may assist in removing the staple or binding element. Thus, as a sheet(s) of a stapled or bound document is grasped by the rotatable drum mechanism 38, the extended surface 36*a* and its teeth 36*b* may intercede by holding or providing resistance to at least the top edge (e.g., near the staple) of the stapled documents. Thus, as the rotatable drum 40 feeds the sheet into the shredder mechanism 20, and the cutter elements 21 advance the sheets therethrough, the device 36, 36*a*, 36*b* cooperatively provides resistance to at least the top edge of the document allowing for the paper sheet(s) to be stripped from the stapled edge. Optionally, the extended surface or lip 36*a* of device 36 during operation of the drum mechanism 38 and shredder mechanism 20 provides enough resistance to tear a sheet from the stapled documents, such that as each sheet is grasped and fed toward the shredder mechanism 20 by the rotatable drum 40, the sheet is removed from the stapled document.

Figure 9:
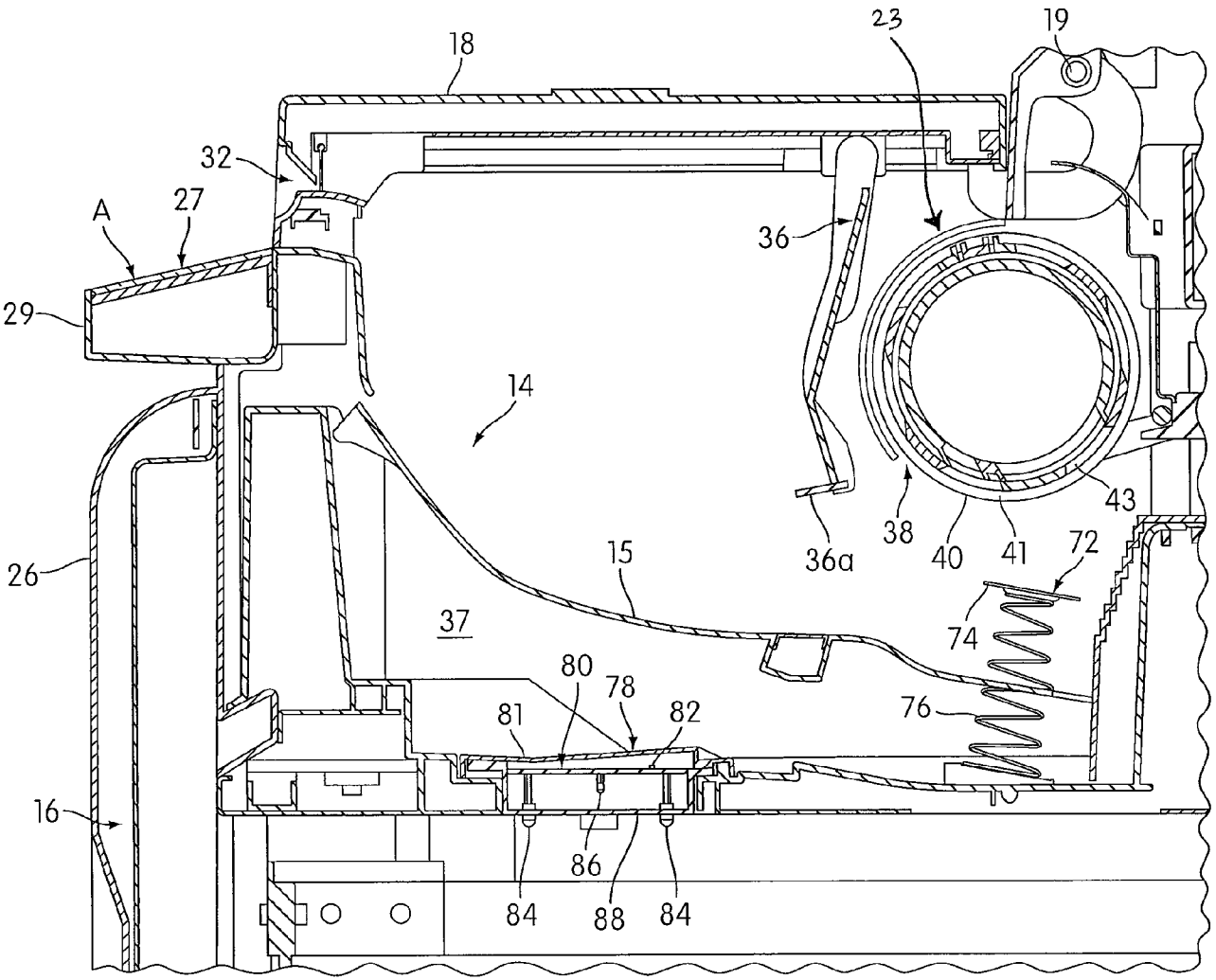
FIG. 9 is a cross section view of the shredder of FIG. 2 with a number of sensing devices.

FIG. 9 is a cross section view of the shredder 10*a* with a number of sensing devices therein. Any number of sensing devices or sensors may be used with the shredders 10 or 10*a*. For example, in embodiments, the shredder may comprise one or more waste level or bin full sensing devices 83 operable to detect an accumulation of shredded particles discharged by the shredder mechanism. That is, the waste level sensor 83 may determine an amount of space available in waste container 16 for collecting shredded particles. In embodiments, the waste level sensing device(s) 83 may be devices which utilize light or radiation for bin full detection, such as the examples described in U.S. patent application Ser. No. 12/355,589, filed Jan. 16, 2009, and U.S. Pat. No. 6,978,954, issued Dec. 27, 2005, both assigned to the same assignee of the present disclosure. The waste level sensor(s) 83 may comprise a single device for emitting and detecting radiation. In the embodiment shown in FIG. 9, the waste level sensor(s) 83 comprise a plurality (e.g., two) light-emitting diodes (LEDs) or optical sensors 84, and a detection sensor 86. The radiation emitted by the sensors 84 may include light in the visible spectrum, infrared radiation (IR), and/or ultraviolet radiation. Shredded particles being discharged by the shredder mechanism 20 and accumulated in the container 16 or bin will be detected by the sensing device(s) 83.

The LED sensors 84 and detection sensor(s) 86 of sensing device 83 may be located in a number of locations in the shredder 10. For example, in some embodiments, the detection sensor(s) 86 may be provided adjacent or behind a clear or transparent window or lens 88, so as to prevent dust or particles from affecting the sensor reading. The sensing devices 84 and 86 are positioned to emit and detect radiation, respectively, with respect to the bin or container 16. In some embodiments, a plurality of sensors or a series of LEDs may be arranged in a spaced apart relation. Generally, any number of LED sensing devices may be provided, and mounted in several ways, and therefore should not be limiting.

More specifically, one or more waste level/bin full sensing devices 83 may be provided on the bottom wall or lower side of the shredder housing 12. In some embodiments, the sensing device(s) 83 may be provided near or adjacent the output opening or throat of the shredder. The mounting or housing of waste level sensor(s) 83 on or in the shredder 10 or 10*a* should not be limited to those embodiments depicted herein.

Waste level or bin full sensor(s) 83 are also operatively connected to the shredder mechanism 20. For example, as articles are shredded by the cutter elements, shredded particles are discharged by the shredder mechanism 20 and into container 16. As the shredded particles build up, the sensing device(s) 83 may detect the accumulation or level of shredded particles in the container 16 and thus warn the user or, alternatively, detect that the container 16 is full and thus communicate with a controller 47 to stop operation of the shredder mechanism 20 until the container 16 is at least partially emptied.

Of course, other types of sensors may also be used for bin full detection. For example, in embodiments, waste level sensing device(s) may utilize sonic detection, wherein ultrasonic waves are reflected and detected to determine an amount of shredded particles in a container 16. Generally, sensors with ratio metric output may be used to determine a waste level in the waste container 16.

In embodiments, one or more queue sensors 77 may be provided in the shredder. A queue sensor 77 is defined as a sensor that is provided to estimate or determine an amount of material or articles that are provided on the bed 15 of the tray 14 which are to be shredded by shredder mechanism 20. The queue sensor 77 may determine a weight, level, or thickness of articles in tray 14, for example. In some cases, the queue sensor 77 may be used to determine a length of time required to shred articles in queue on the bed 15. In other cases, as noted below with respect to FIGS. 11 and 12, the queue sensor 77 may be used to dynamically determine via controller 47, along with the waste level sensor 83, for example, the space available in the container 16 versus the amount of articles to be shredded in the tray 14.

In some embodiments, the queue sensor 77 may be a load sensor. Alternatively, a tilt sensor, strain gauge, optical encoder, or any number of other sensors may be used to determine the amount of articles queued to be shredded in the tray 14. The queue sensor 77 may comprise a hall sensor 82 and a magnet (not shown). The hall sensor 82 may be provided in a location adjacent a bottom of the tray 14, such as in housing 12 or on container 16 (e.g., see FIG. 9). The magnet (not shown) may be mounted on a bottom portion of the bed 15 or tray 14, for example. Thus, in an embodiment, the hall sensor 82 is designed to detect a magnetic field from the magnet (not shown). More specifically, the tray 14 and its bed 15 are capable of movement with respect to the weight of the articles placed thereon and in queue for shredding by the shredder mechanism 20. For example, the tray 14 may comprise a hinge or movement member and/or a push member 72 that adjusts a top edge or height of the articles on the feed bed 15 in relation to the rotatable drum mechanism 38. The tray 14 may move pivotally or vertically with respect to the housing 12, for example. The push member 72 may comprise a platform 74 and a resilient member 76, such as spring. For illustration purposes only, the platform 74 and resilient member 76 are shown in FIG. 9 in an extended configuration. However, it is to be understood that the platform 74 may be mounted or connected to an underside of the tray 14 such that the resilient member 76 is in a compressed position and capable moving a forward portion of the tray, near the drum mechanism 38, based upon the weight of the articles in queue, so that the bed 15 is kept in a nominal position for shredding. In embodiments, the spring constant of the resilient member 76 may be chosen such that the tray 14 and feed bed 15 are adjusted to a predetermined height in relation to the drum mechanism 38. For example, in some cases, the push member 72 may be used to adjust the bed 15 such that a predetermined amount of space is provided between the drum 40 and tray 14, so that the exhaust or air from the nozzle 48 is able to lift sheets for shredding.

In other embodiments, a sensor may be provided in tray 14 for sensing the presence of articles, paper sheets, or a stack 22. The sensor may be used to communicate with the controller that sheets are ready to be shredded or destroyed, or to communicate with the feed driver system or queue sensor 77. The presence of sheets may also start a timer after being detected by a sensor. For example, a time delay may be activated such that a feed mechanism 23 begins to move or rotate after a set period of time (e.g., 30 minutes, 1 hour). The sensor may be of any type, e.g., optical, electrical, mechanical, etc. and should not be limiting. In some cases, for example, the queue sensor 77 may be the sensor used to sense the presence of articles in the tray 14.

Additionally, audio and/or vibration sensors may be used with tray 14. For example, an audio/vibration sensor may be able to pick-up audio signals or sounds when paper is shredding or as paper is lifted. U.S. Provisional Patent Application 61/226,902, filed Jul. 20, 2009, which is hereby incorporated by reference in its entirety, describes one example of a audio/vibration sensor that may be used with the shredders 10 and/or 10*a*.

Figure 10:
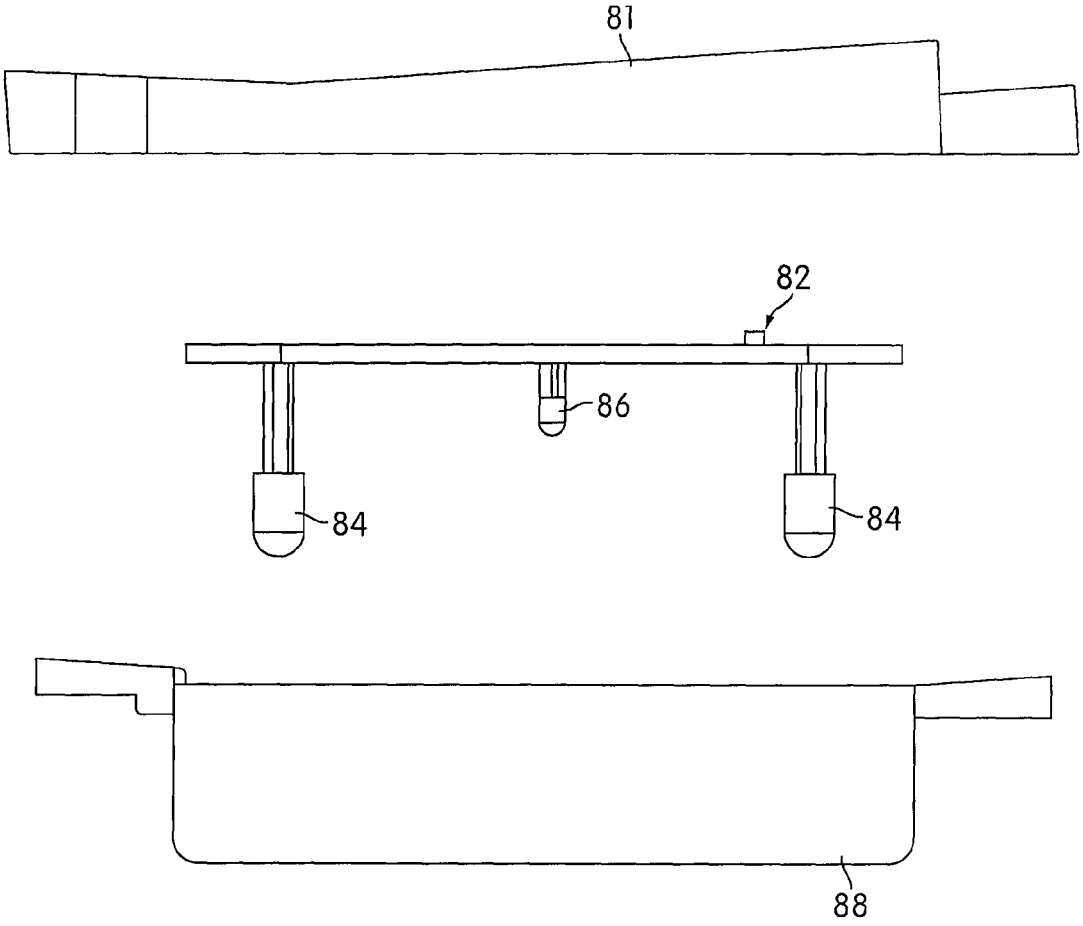
FIG. 10 illustrates a detailed, exploded view of a housing with a circuit board and sensing devices, provided in relation to the tray of the shredder in accordance with an embodiment of the present invention.

FIG. 10 illustrates a detailed, exploded view of a housing 78 with a circuit board 80 and sensing devices 77 and 83, provided in relation to the tray 14 of the shredder in accordance with an embodiment. For example, the housing 78 may be provided on or in an underside wall 81 adjacent to the tray 14. The housing 78 may include a printed circuit board (PCB) 80 therein, with hall sensor 82, LED sensors 84, and detection sensor 86 mounted thereto. For example, the hall sensor 82 may be provided on a topside of the PCB 80, to face the magnet (not shown), and the waste level sensing devices 83 may be provided on a bottom side to facing downwardly, into the container 16. The elements of the sensing devices 77 and 83 may be at least partially enclosed by the top cover 81 and bottom portion 88 of the housing 78. As previously noted, at least a part of the bottom portion 88 may be in the form of a transparent window or lens. In some cases, the entire bottom portion 88 may be a transparent element.

The readings from the sensing devices provided in the shredder 10 or 10*a* may be used cooperatively determine information relating to shredding that may be useful for users. For example, in shredding machines or apparatuses with large paper queues in which the user can place large volumes of paper or articles to be shredded within the bed 15 or tray 14, the shredder 10 or 10*a* may use one or more of its sensing devices (e.g., sensors 77 and 83) to assist in determining alternative possible errors or problems associated with shredding, in addition to their designated determinations. That is, besides just determining that articles are in queue for shredding, or that a bin or container 16 has a waste level that is or is close to full, sensed conditions may be further used for additional determinations or calculations.

Figure 12:
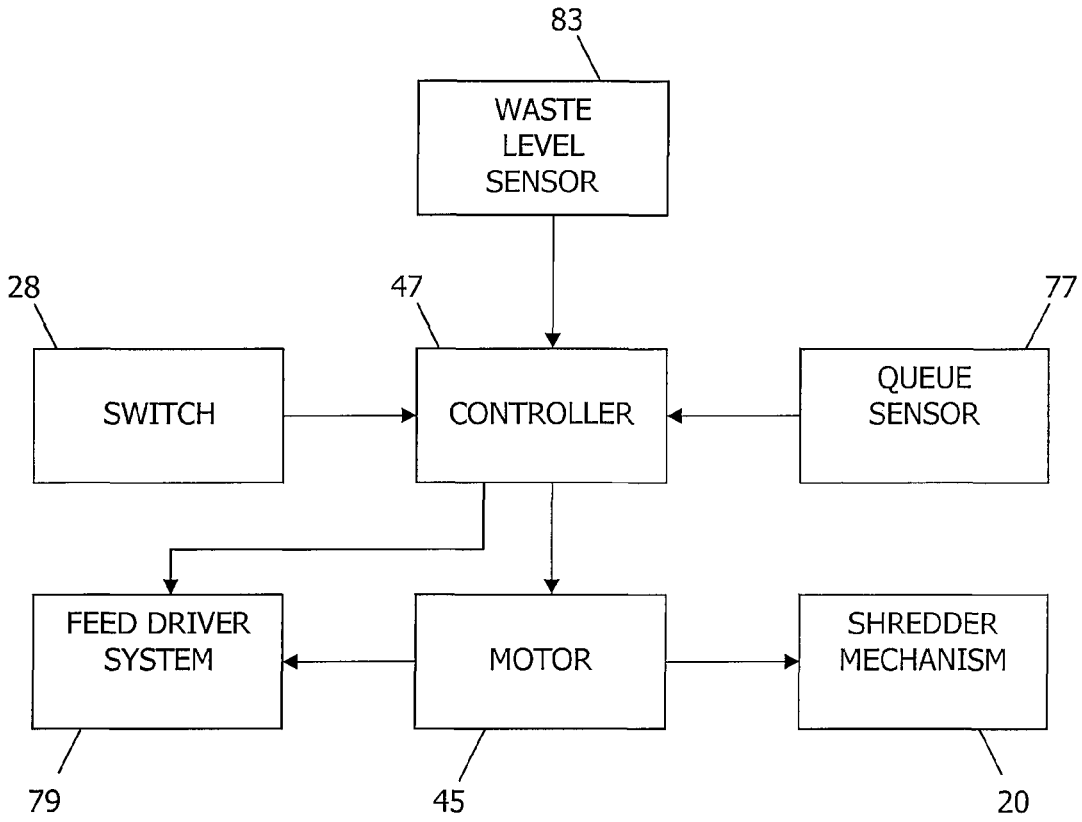
FIG. 12 is a schematic illustration of interaction between a controller and other parts of the shredder.

For example, FIG. 12 is a schematic illustration of interaction between a controller 47 and other parts of the shredder. More specifically, FIG. 12 shows the controller 47 coupled with switch 28, queue sensor 77, waste level sensor 83, feed driver mechanism 79, motor 45, and shredder mechanism 20. Such elements of the shredder, however, are not meant to be limiting. Although not specifically shown in FIG. 12, other detector or sensing devices may be used in conjunction with the shredder 10. For example, a thickness detector that is used to determine the thickness of articles received in the shredder mechanism 20 may be used.

The controller 47 may be provided to control operation of the shredder, its mechanisms, and its sensors, for example. The controller 47 may include a microcontroller or a timer circuit. The controller 47 may be configured to start a running operation of the motor 45 responsive to the power switch 28 being turned to an "on" position. The controller 47 may be configured to start a running operation of the motor 45 to speed responsive to the queue sensor 77 detecting the presence of articles in or received by the tray 14. The controller 47 may be configured to start one or more motors 45 in order to activate the shredder mechanism 20 and/or the feed driver system 79 of the feed mechanism 23. That is, the controller 47 is capable of controlling operation of the motor 45 that powers the rotation of the cutter elements 21 on their respective shafts of the shredder mechanism 20. In some cases, the same motor 45 may be used to power the feed driver system 79 for the feed mechanism 23. Of course, it is to be understood that a same motor or different motors may be used for activating such parts of the shredder 10. Thus, motor 45 is representative of one or more motors. In any case, the controller 47 may also be used to control the activation of the feed mechanism 23. In some cases, the controller 47 may be used to adjust the speed of the motor 45. For example, the controller may be configured to incrementally increase or incrementally decrease the speed of the motor 13 and/or start or stop the motor responsive to one or more detectors or sensors, such as queue sensor 77 and waste level sensor 83.

In an exemplary embodiment, as noted above, detecting or sensing devices 77 and 83 may be used to assist in determining alternative possible errors or problems associated with shredding. For example, the waste level sensor 83 may be used in conjunction with the queue sensor 77 to determine an amount of space available in the container 16 (e.g., using a detection of an accumulation of shredded particles discharged by the shredder mechanism 20) relative to an amount of material to be shredded in the bed 15 and/or tray 14 (or vice versa, i.e., the amount of material to be shredded may be compared to the amount of space available in the container 16). Such information is useful for determining if all of the articles in queue for shredding can be shredded before the container 16 is determined to be full (and, for example, before the shredding operation is stopped). For example, if the user places one-half (½) the rated capacity of articles into the tray 14 and the shredder detects that there is only enough room in the container 16 for shredded particles of one-third (⅓) of the queue, the shredder can alert the user (e.g., via control panel A or other alarm devices (noise, lights, etc.)) that the stack 22 will not be completely shredded prior to the container becoming full. Such information may be useful to a person shredding confidential or sensitive documents, for example.

As such, the controller 47 may be figured to compare the accumulation/amount of space to the amount of articles provided on the tray in order to perform a predetermined operation of the shredder 10. For example, in embodiments, the operation may be to determine an operation for the shredder mechanism 20 and/or feed driver system 79. In some cases, the controller 47 may determine the operation for the feed driver system 79 which comprises the controller determining a starting operation for driving the feed mechanism 23 (or drum 38). In other cases, the operation for the feed driver system 79 may comprise determining a stopping operation for stopping the driving of the feed mechanism 23. In other cases, the controller 47 may determine the operation for the shredder mechanism 20 which comprises using the controller 47 to prevent the motor from driving the cutter elements. For example, in a case where it is determined that all of the articles in the tray 14 or bed 15 could not be shredded before the container 16 is deemed full, the controller 47 may be configured to prevent the motor 45 from driving the cutter elements/shredder mechanism. In some instances, the controller 47 may provide or activate an alarm to provide an alarm indication to alert a user of such an incident (i.e., that the amount of articles exceeds an amount of available space for collecting the accumulation of shredded particles). The alarm indication may include illuminating a visual indicator and/or sounding an audible alarm indicator, and, in some cases, may be provided on the control panel A, for example. According to an aspect of the present invention, the controller 47 is configured to vary running operation of the motor responsive to the one or more sensing devices. Additionally, the controller 47 may be configured to stop the motor 45 when the sensor 83 determines that the container 16 is full of shredded particles, and/or when it is determined that articles have been added to the tray 14 (e.g., via slot 32) that can not be fully shredded before bin full is detected.

Figure 11:
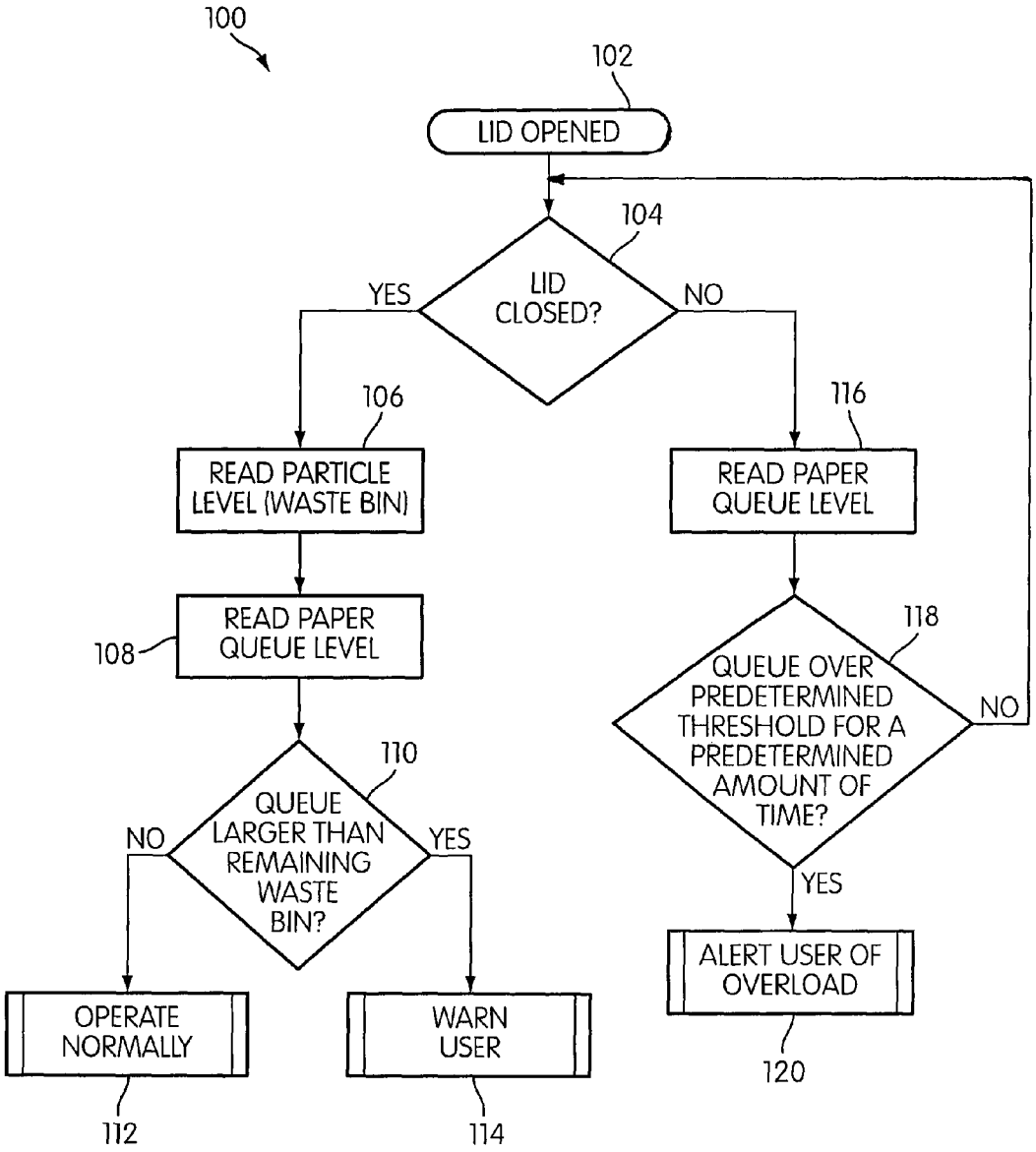
FIG. 11 illustrates a flow chart diagram illustrating a method for dynamically determining operation of a shredder using sensing devices in accordance with an embodiment of the present invention.

FIG. 11 illustrates a flow chart diagram illustrating a method 100 for dynamically determining operation of a shredder using sensing devices such as waste level sensing device 83 and queue sensor 77. In this embodiment, the method 100 starts at 102 when the lid is opened for insertion of articles or paper into the tray 14. In some cases, for example, opening of the lid at 102 may not be performed. For example, articles may be inserted into the slot 32 of the lid 18 of the shredder 10*a*. Therefore, the method 100 may also or alternatively determine at 104 if the lid is closed. Such steps are useful, for example, with regard to activating the shredder mechanism 20 and/or the feed driver system 79 of the feed mechanism 23.

In any case, if the lid is determined to be closed at 104, i.e., "YES," the shredded particle level in the waste bin or container 16 is sensed or read at 106 using waste level sensor 83, for example. The read particle or waste level in the container 16 may be used to deduce or determine an amount of space remaining in the container 16 for collecting shreds. Thereafter, the paper queue level in the bed 15 of the tray 14 is then sensed or read using queue level sensor 77, for example. The sensor readings or determinations are then compared at 110. That is, it may be determined if the read queue level at 108 is larger than the determined amount of space remaining in the container 16 or waste bin. If the queue level is not determined to be larger, i.e., "NO," the shredder and its shredder mechanism 20 (and/or feed drive system 79) may operate normally to shred the articles within the tray 14.

However, if the queue level is determined to be larger than the amount of space remaining in the container 16, i.e., "YES," then a warning may be issued at 114 for the user. As noted above, such a warning may be provided in the form of an alarm indication via sound or visual devices, for example. Thereafter, the user may be given the option to direct the shredder to continue operation or to start an operation for shredding the articles and/or feed the articles into the shredder mechanism anyway. Alternatively, the user may be given the option to empty the container 16 before continuing/starting operation of the feed driver system and/or shredder mechanism.

FIG. 11 also shows a method for using the queue sensing device 77 to determine possible overload in the tray 14. For example, at 104, if the lid of the shredder is not determined to be closed, i.e., "NO," the paper queue level in the bed 15 of the tray 14 may be sensed or read at 116 using queue level sensor 77. Instead of comparing the queue to the particle level/accumulation/amount of space in the waste container 16, it may be determined at 118 if the read queue level is over a predetermined threshold for a predetermined amount of time. That is, the amount of articles in the tray 14 is determined and read over a period of time. In some cases, the amount of articles determined by the queue may be initially over a predetermined threshold. If the read queue level is not over the threshold after the predetermined amount of time, i.e., "NO," the method 100 returns at 104, to determine if the lid is closed, and an operation for the shredder is determined (as noted above), or the paper queue level is again read at 116.

If, however, the read queue level or amount is determined to be over the threshold after the predetermined amount of time, i.e., "YES," the user is alerted of the overload at 120, using a warning or alarm indication device as noted above. Thereafter, the shredder may be held not to operate the shredder mechanism 20 until the overload is cleared from the tray 14, for example, or the user initiates an override for allowing a shredding operation anyway.

Of course, alternate sensing devices or alternate situations may be determined. The logic flow diagram of FIG. 11 merely illustrates some examples of determining shredding progress and is not meant to be limiting.

The advancement mechanism (i.e., rotating drum mechanism 38) for "automatically" feeding one or more sheets as described in FIGS. 3-6*e* allows a user to drop off a stack of paper sheets or documents without having the need to manually feed individual or a present quantity of sheets into the shredder 10. For example, a user would add a stack of documents to the tray 14 and be able to walk away. The shredder 10 may then either automatically engage in shredding the documents in the tray 14 (e.g., upon closure of the lid 18 or via sensor), or set a preset timer so as to delay the time the shredder 10 is activated for the shredding process to begin. A user may also activate the shredding process by pushing a button on the control panel A (e.g., button 56).

One advantage of the described advancement mechanism in shredder 10 or 10*a* is the decreased amount of time a user must spend shredding documents. For example, the productivity of a user would be improved since the user is able to perform other tasks while the shredder 10 or 10*a* is activated. Further, the dynamic relationship between the queue sensor (s) 77 and waste level sensor(s) 83, which determines the space available in the shred bin or container 16 relative to the amount of material to be shredded in the bed 15/tray 14, may be useful in determining if a stack 22 will not be completely shredded, thus allowing a user to prevent the shredder from sitting with a fault condition with confidential documents left in the queue, for example.

Another advantage is that the shredder 10 or 10*a* is designed to handle paper or documents of different sizes, textures, shapes, and thicknesses, including letter, legal, and A4 size paper, as well as envelopes and stapled sheets, for example. The documents may also be in any order.

Also, the blowing or fluidizing action from the fan 46 (via nozzle 48) causes the sheet(s) from the stack 22 of articles to lift and rise to meet the surface 52 of the rotatable drum 40. The drum 40 need not come into contact with the stack 22 in order to feed or advance the articles to be shredded. Furthermore, the space between the stack 22 of articles and the rotatable drum 38 provides advantages. The space allows multiple sheets to be lifted and fed in a constant, overlapping basis into the shredder mechanism 20, thereby reducing the amount of time required for shredding a stack in the tray 14. The space regulated the feeding of articles into the shredder mechanism 20.

Optionally, the shredder 10 or 10*a* may be utilized in a system having a centrally located shredder unit for a multitude of users. For example, the shredder 10 or 10*a* allows for each individual to save what they need to shred at a later time in their own individual tray. An individual can fill his or her own tray until shredding is needed. Each individual may then insert the tray into the shredder 10 or 10*a*. In an embodiment, each individual tray may comprise a locking mechanism, such that documents may be secured within the tray, as well as to the work area of the individual, for additional security of the documents to be shredded.

The shredder 10 or 10*a* may also be utilized in a system wherein users use a mobile cart device to pick up items to be shred, for example. The cart device may be used to pick up individual trays or allow users to securely add documents that need to be shredded to a locked tray. Thus, other users or services may be used to shred documents without having access to such documents.

Also, features shown and described herein can be implemented on any type of auto feed shredder device, and need not be limited to the embodiments provided. For example, in embodiments, it is envisioned that the queue sensor 77 and waste level sensor 83 and method of using said sensors may be incorporated into auto feed shredding apparatuses such as those described in U.S. Patent Application Publications 2005/0274836 A1 and/or 2006/0249609 A1, and/or U.S. Pat. No. 5,884,855.

While the principles of the invention have been made clear in the illustrative embodiments set forth above, it will be apparent to those skilled in the art that various modifications may be made to the structure, arrangement, proportion, elements, materials, and components used in the practice of the invention.

For example, in some embodiments, the shredder 10 or 10*a* may include a stripper device of alternative configuration, as is described in the incorporated patent application, U.S. application Ser. No. 11/777,827. Such a stripper device may comprise a holding portion and a pivoting portion, and may also be used in accordance with or alternatively to the stripper device 36 to strip paper sheets that are stapled together in the stack 22. In an embodiment, when both stripper devices 36 and are used in shredder 10 or 10*a*, the devices work in cooperation with the auto feed mechanism or advancement mechanism 23 to feed stapled documents or sheets from the tray. The use of both stripper devices may provide an advantage to the user in that the user does not need to place or orient the documents/sheets in the tray 14 or bed 15 in a specific matter. Specifically, the orientation of the sheets may be such that stapled documents/sheets are placed in the tray 14 with the direction of the staples being adjacent the shredder mechanism 20 and/or behind the feed mechanism 23 (e.g., toward the opening of the tray 14). Despite the orientation of the staples, the devices will provide resistance to at least the top sheet(s) 30 being fed into the cutter elements 21 and pull or strip the sheet(s) 30 from the staple or binding device.

Additionally, features such as rotatable raking mechanism for moving shredded materials adjacent the outlet of a shredder mechanism are also envisioned, in accordance with some embodiments, to be used with the shredder 10 or 10*a*. An example of such a mechanism which may be used is described in U.S. patent application Ser. No. 12/314,182, assigned to the same assignee.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a housing;

a shredder mechanism received in the housing and including a motor and cutter elements, the motor rotating the cutter elements in an interleaving relationship for shredding articles fed therein;

a tray for holding a stack of articles to be fed into the cutter elements;

a feed mechanism for feeding articles from the tray to the cutter elements of the shredder mechanism, the feed mechanism comprising an engaging surface for engaging articles;

a feed driver system constructed to drive the feed mechanism to feed articles to the cutter elements;

the shredder further comprising a waste level sensor operable to detect an accumulation of shredded particles discharged by the shredder mechanism and a queue sensor operable to determine an amount of articles provided on the tray, and a controller coupled to the shredder mechanism, feed driver system, waste level sensor, and queue sensor, the controller being configured to compare the accumulation of shredded particles detected by the waste level sensor to the amount of articles provided on the tray detected by the queue sensor in order to perform a predetermined operation of the shredder.

2. The shredder according to claim 1, wherein the operation is for the feed driver system and wherein the operation comprises the controller determining a starting operation for driving the feed mechanism.

3. The shredder according to claim 1, wherein the operation is for the feed driver system and wherein the operation comprises the controller determining a stopping operation for stopping the driving of the feed mechanism.

4. The shredder according to claim 1, wherein the operation is for the shredder mechanism and wherein the operation comprises using the controller to prevent the motor from driving the cutter elements.

5. The shredder according to claim 1, wherein the operation is for the controller and wherein the controller is configured to activate an alarm to provide an alarm indication to alert a user that the amount of articles provided on the tray for shredding exceeds an available space for collecting the accumulation of shredded particles.

6. A shredder according to claim 1, wherein the shredder further comprises a waste container for receiving the accumulation of shredded particles from the cutter elements.

7. A shredder according to claim 1, wherein feed mechanism is positioned above the tray.

8. A shredder according to claim 1, wherein the engaging surface of the feed mechanism is at least in part air permeable and rotatable.

9. A shredder according to claim 8, wherein the feed mechanism comprises a rotatable drum.

10. A shredder according to claim 9, wherein the shredder further comprises a vacuum generator for applying a vacuum to an interior of the feed mechanism to draw air through the engaging surface, thereby lifting articles from atop the stack.

11. A shredder according to claim 10, further comprising a fan mechanism constructed and arranged to provide air toward the tray to lift at least an edge of the articles atop of the stack and thereby separate the articles from the stack and into contact with the engaging surface.

12. A shredder according to claim 11, wherein the fan mechanism utilizes exhaust from the vacuum generator.

13. A shredder according to claim 9, wherein the rotatable drum is mounted on an axle, and the feed driver system comprises a rotary driver for rotating the axle so that the rotation of the drum feeds the articles atop the stack to the cutter elements.

14. A shredder according to claim 10, wherein the rotatable drum further comprises an inner cylinder for applying the vacuum and an outer cylinder having the engaging surface, the outer cylinder comprising at least one opening for applying the vacuum, wherein, during rotation, the opening of the outer cylinder provides a concentrated vacuum toward the articles of the stack.

15. A shredder according to claim 1, wherein the tray includes a curved feed bed.

16. A shredder according to claim 1, further comprising a lid for covering the tray, the lid comprising an opening for allowing insertion of articles into the tray.

17. A shredder according to claim 1, wherein the shredder further comprises a device for stripping articles that are stapled together in the stack as the articles are fed to the cutter elements.

18. A shredder according to claim 1, further comprising a removal device adjacent the shredder mechanism to assist in removal of articles from the engaging surface of the feed mechanism.

19. A method for operating a shredder, the shredder comprising a housing; a shredder mechanism received in the housing and including a motor and cutter elements, the motor rotating the cutter elements in an interleaving relationship for shredding articles fed therein; a tray for holding a stack of articles to be fed into the cutter elements; a feed mechanism for feeding articles from the tray to the cutter elements of the shredder mechanism, the feed mechanism comprising an engaging surface for engaging articles; a feed driver system constructed to drive the feed mechanism to feed articles to the cutter elements; a waste level sensor operable to detect an accumulation of shredded particles discharged by the shredder mechanism and a queue sensor operable to determine an amount of articles provided on the tray; a waste container for receiving the accumulation of shredded particles from the cutter elements, and a controller coupled to the shredder mechanism, feed driver system, waste level sensor, and queue sensor, the controller being configured to compare the accumulation of shredded particles detected by the waste level sensor to the amount of articles provided on the tray detected by the queue sensor in order to perform a predetermined operation of the shredder; and the method comprising:

providing the tray for holding a stack of articles;

providing the shredder mechanism;

providing the feed mechanism for feeding articles from the tray to the cutter elements of the shredder mechanism;

providing the waste container for receiving shredded particles from the cutter elements;

determining an amount of articles provided on the tray using the queue sensor;

determining an amount of space available in the waste container for receiving shredded particles from the cutter elements using the waste level sensor;

using the controller to compare the amount of articles provided on the tray to the amount of space available for collecting shredded particles in the waste container, and, based on a comparison of the amount of articles to the amount of space available, performing a predetermined operation of the shredder.

20. The method according to claim 19, wherein the operation comprises determining a starting operation for rotating the cutter elements in an interleaving relationship for shredding articles fed therein, and driving the feed mechanism to feed the articles to the cutter elements.

21. The method according to claim 19, wherein the operation comprises determining a stopping operation for stopping rotation of the cutter elements and for stopping the driving the feed mechanism to feed the articles to the cutter elements.

22. The method according to claim 19, wherein the operation comprises using the controller to prevent the motor from driving the cutter elements.

23. The method according to claim 19, wherein the operation comprises activating an alarm to provide an alarm indication to alert a user that the amount of articles provided on the tray for shredding exceeds the amount of space available in the container.

24. The method according to claim 19, wherein the amount of space available in the waste container is determined by using the waste level sensor to detect an accumulation of shredder particles discharged by the cutter elements of the shredder mechanism.

25. The method according to claim 19, wherein the feed mechanism is positioned above the tray.

26. The method according to claim 19, wherein the engaging surface of the feed mechanism is at least in part air permeable and rotatable.

27. The method according to claim 26, wherein the feed mechanism comprises a rotatable drum.

28. The method according to claim 27, further comprising: applying a vacuum to an interior of the feed mechanism to draw air through the engaging surface, thereby lifting articles from the tray to the engaging surface of the drum.

29. The method according to claim 28, further comprising rotating a fan mechanism to supply air to lift at least an edge of articles and thereby separate the articles in the tray and into contact with the engaging surface.

30. The method according to claim 29, further comprising directing exhaust from the vacuum toward the tray to lift the articles to act as the fan mechanism.

31. The method according to claim 27, wherein the rotatable drum is mounted on an axle, and wherein the method further comprises rotating the axle using a rotary driver of a feed driver system of the feed mechanism so that the rotation of the drum feeds the articles to the cutter elements.

32. The method according to claim 31, wherein the rotatable drum further comprises an inner cylinder for applying the vacuum and an outer cylinder having the engaging surface, the outer cylinder comprising at least one opening for applying the vacuum, wherein, during rotation of the drum, the opening of the outer cylinder provides a concentrated vacuum toward the articles of the stack.

33. The method according to claim 19, wherein the tray includes a curved feed bed.

34. The method according to claim 19, further comprising stripping articles that are stapled together in the tray using a stripping device when the articles are fed to the cutter elements.

35. The method according to claim 19, further comprising removing articles from the feed mechanism using a removal device adjacent the shredder mechanism.

* * * * *